US006712441B2

(12) United States Patent
Sato et al.

(10) Patent No.: US 6,712,441 B2
(45) Date of Patent: Mar. 30, 2004

(54) PRINTING APPARATUS AND METHOD IMPLEMENTING SMOOTH OUTLINE

(75) Inventors: Akito Sato, Nagano-ken (JP); Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 10/072,636

(22) Filed: Feb. 11, 2002

(65) Prior Publication Data

US 2002/0135626 A1 Sep. 26, 2002

(30) Foreign Application Priority Data

Feb. 16, 2001 (JP) ..... 2001-039482
Oct. 2, 2001 (JP) ..... 2001-306643

(51) Int. Cl.[7] ..... B41J 2/205
(52) U.S. Cl. ..... 347/15; 347/43; 347/14; 358/1.2

(58) Field of Search ..... 347/15, 43, 14, 347/41, 16; 358/1.2, 1.9, 1.11, 521

(56) References Cited

U.S. PATENT DOCUMENTS 6,341,832 B1 * 1/2002 Narushima ..... 347/14

* cited by examiner

*Primary Examiner*—Lamson Nguyen

(57) ABSTRACT

The printing apparatus of the present invention allows dots to be formed after being selected from dot types whose number is greater than the number of gradations in each of the pixels constituting print data received from outside the printing apparatus. In the process, dots are formed for each gradation value after being selected from a plurality of types of dots having different sizes and/or formation positions such that the outlines contained in the printed image are smoothed, making it possible to smooth the outlines of line drawings while minimizing any increase in the volume of data transmitted from the outside and believed to cause a reduction in the printing speed.

39 Claims, 26 Drawing Sheets

Second Embodiment (1440dpi × 360dpi)

Smoothing Process for the First Embodiment of Present Invention
Fig.6A
| | a | b | c | d | e | f | g |
|---|---|---|---|---|---|---|---|
| 1 | 0 | 0 | 0 | 0 | 0 | 0 | 0 |
| 2 | 0 | 0 | 1 | 1 | 1 | 0 | 0 |
| 3 | 1 | 1 | 1 | 1 | 1 | 1 | 1 |
Fig.6B
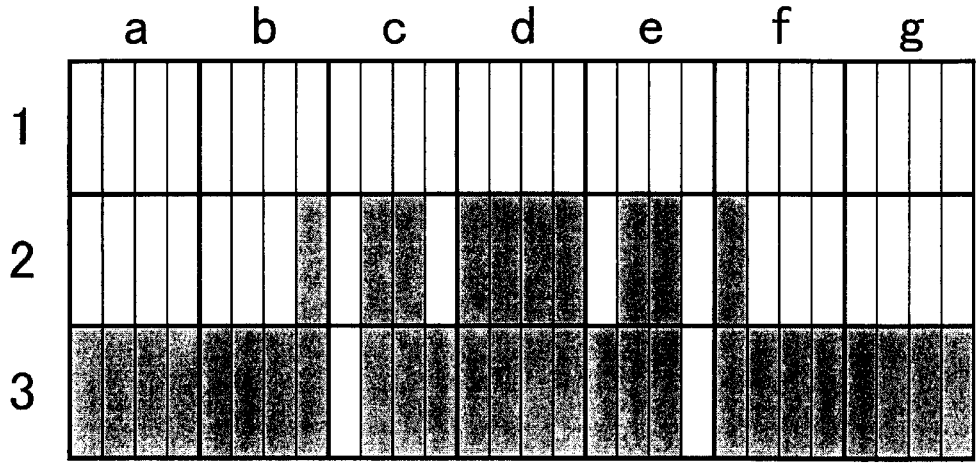
Fig.6C
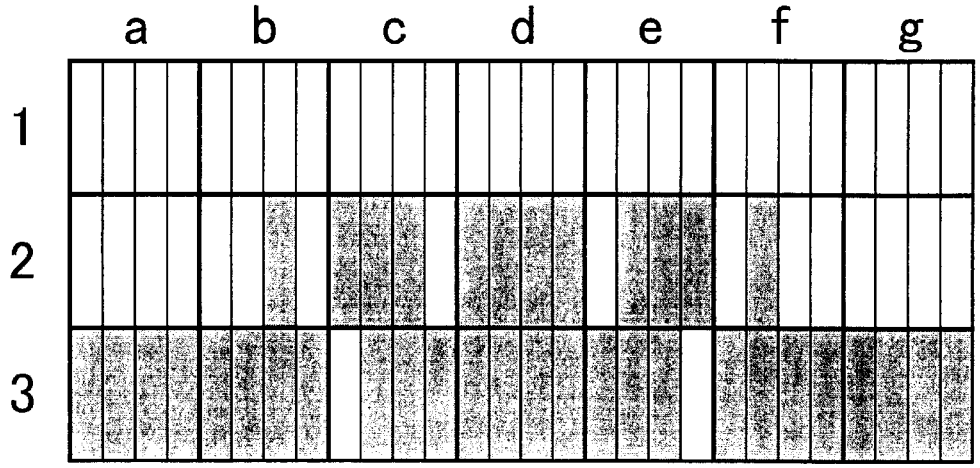

| | a | b | c |
|---|---|---|---|
| 1 | 0 | 0 | 0 |
| 2 | 0 | 0 | 1 |
| 3 | 1 | 1 | 1 |

| | b | c | d |
|---|---|---|---|
| 1 | 0 | 0 | 0 |
| 2 | 0 | 1 | 1 |
| 3 | 1 | 1 | 1 |

| | c | d | e |
|---|---|---|---|
| 1 | 0 | 0 | 0 |
| 2 | 1 | 1 | 1 |
| 3 | 1 | 1 | 1 |

*Fig. 8A* First Mask Pattern (MPS: 00)
(A-0)DTS:0 (A-1)DTS:1
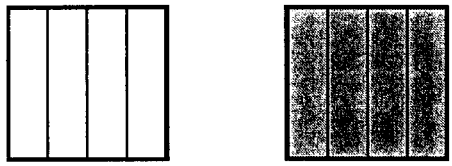
*Fig. 8B* Second Mask Pattern (MPS: 01)
(B-0)DTS:0 (B-1)DTS:1
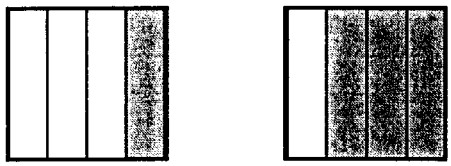
*Fig. 8C* Third Mask Pattern (MPS: 10)
(C-0)DTS:0 (C-1)DTS:1
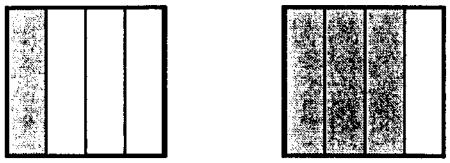
*Fig. 8D* Fourth Mask Pattern (MPS: 11)
(D-0)DTS:0 (D-1)DTS:1
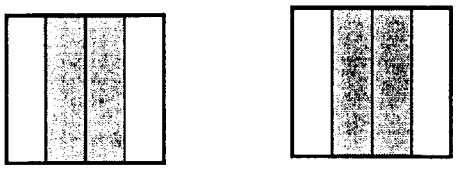

Drive Signals Generated with Second Mask Pattern
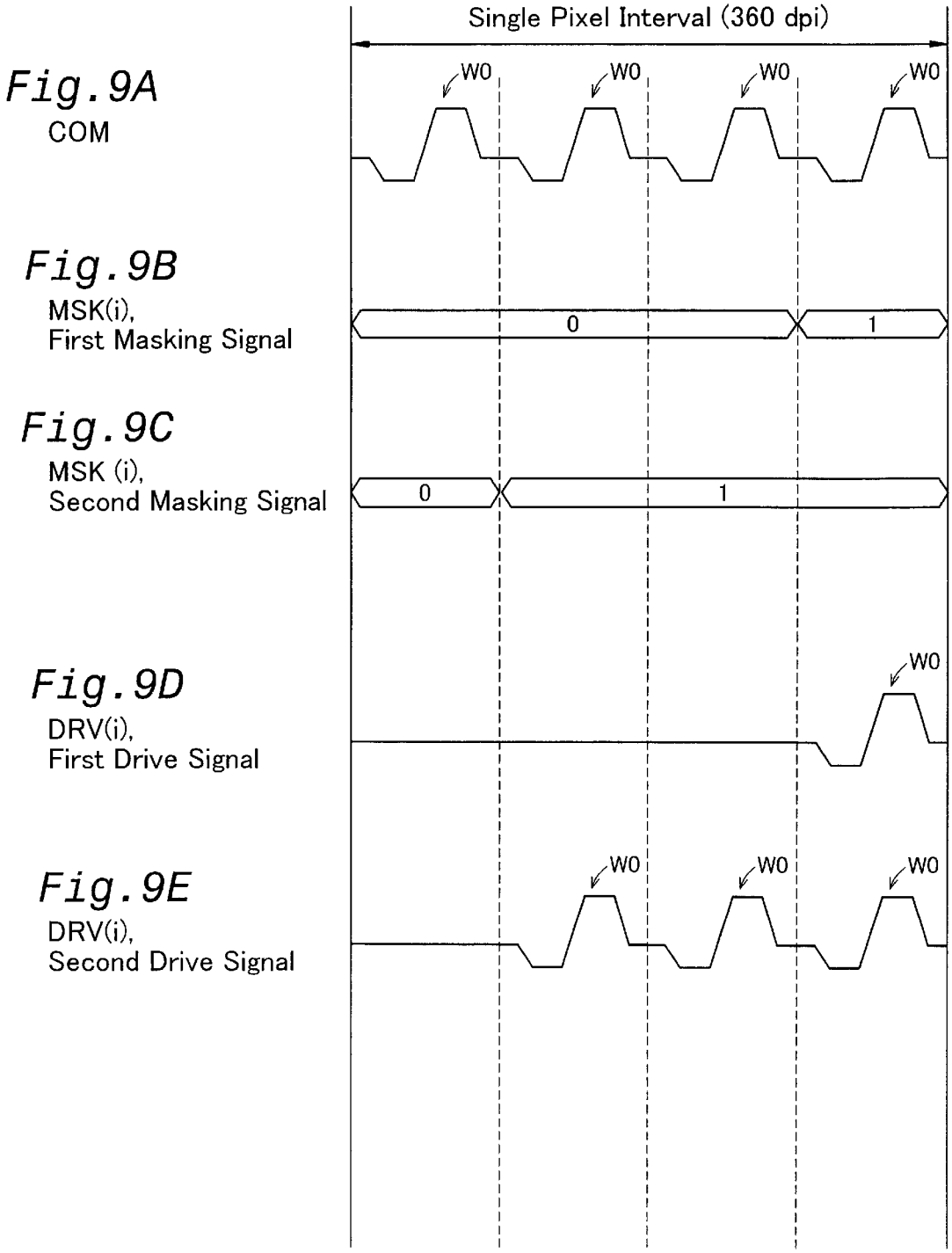

*Fig. 10A*

Truth Table for First Mask Pattern

| DTS | V1 | V0 | /Q1 | /Q0 | MSK | Cell |
|---|---|---|---|---|---|---|
| 0 | 0 | 1 | 0 | 0 | 0 | T21 |
| | 0 | 1 | 0 | 0 | 0 | T22 |
| | 0 | 1 | 0 | 0 | 0 | T23 |
| | 0 | 1 | 0 | 0 | 0 | T24 |
| 1 | 0 | 1 | 0 | 1 | 1 | T21 |
| | 0 | 1 | 0 | 1 | 1 | T22 |
| | 0 | 1 | 0 | 1 | 1 | T23 |
| | 0 | 1 | 0 | 1 | 1 | T24 |

*Fig. 10B*

Truth Table for Second Mask Pattern

| DTS | V1 | V0 | /Q1 | /Q0 | MSK | Cell |
|---|---|---|---|---|---|---|
| 0 | 0 | 0 | 0 | 0 | 0 | T21 |
| | 0 | 1 | 0 | 0 | 0 | T22 |
| | 0 | 1 | 0 | 0 | 0 | T23 |
| | 1 | 1 | 1 | 0 | 1 | T24 |
| 1 | 0 | 0 | 0 | 0 | 0 | T21 |
| | 0 | 1 | 0 | 1 | 1 | T22 |
| | 0 | 1 | 0 | 1 | 1 | T23 |
| | 1 | 1 | 1 | 1 | 1 | T24 |

*Fig. 11A*

Truth Table for Third Mask Pattern

| DTS | V1 | V0 | /Q1 | /Q0 | MSK | Cell |
|---|---|---|---|---|---|---|
| 0 | 1 | 1 | 1 | 1 | 1 | T21 |
| | 0 | 1 | 0 | 0 | 0 | T22 |
| | 0 | 1 | 0 | 0 | 0 | T23 |
| | 0 | 0 | 0 | 0 | 0 | T24 |
| 1 | 1 | 1 | 1 | 1 | 1 | T21 |
| | 0 | 1 | 1 | 0 | 1 | T22 |
| | 0 | 1 | 1 | 0 | 1 | T23 |
| | 0 | 0 | 0 | 0 | 0 | T24 |

*Fig. 11B*

Truth Table for Fourth Mask Pattern

| DTS | V1 | V0 | /Q1 | /Q0 | MSK | Cell |
|---|---|---|---|---|---|---|
| 0 | 0 | 0 | 0 | 0 | 0 | T21 |
| | 1 | 1 | 1 | 1 | 1 | T22 |
| | 1 | 1 | 1 | 1 | 1 | T23 |
| | 0 | 0 | 0 | 0 | 0 | T24 |
| 1 | 0 | 0 | 0 | 0 | 0 | T21 |
| | 1 | 1 | 1 | 1 | 1 | T22 |
| | 1 | 1 | 1 | 1 | 1 | T23 |
| | 0 | 0 | 0 | 0 | 0 | T24 |

Comparative Example (360dpi × 360dpi)

Direction of Main Scanning

Direction of Sub-Scanning

Outline Data

Recorded Character

Second Embodiment (1440dpi × 360dpi)

Outline Data

Direction of Main Scanning

Direction of Sub-Scanning

Recorded Character

Fig. 15A Dot Types Formable with First Mask Pattern

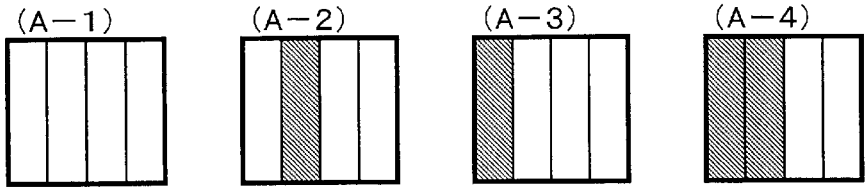

Fig. 15B Dot Types Formable with Second Mask Pattern

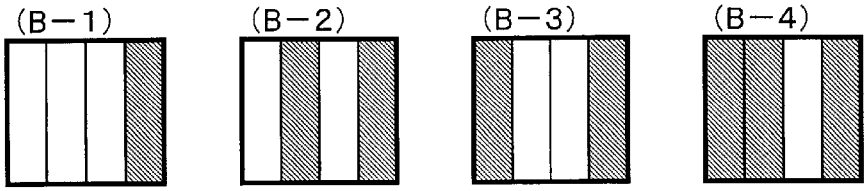

Fig. 15C Dot Types Formable with Third Mask Pattern

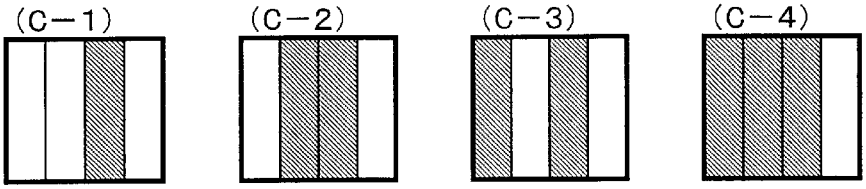

Fig. 15D Dot Types Formable with Fourth Mask Pattern

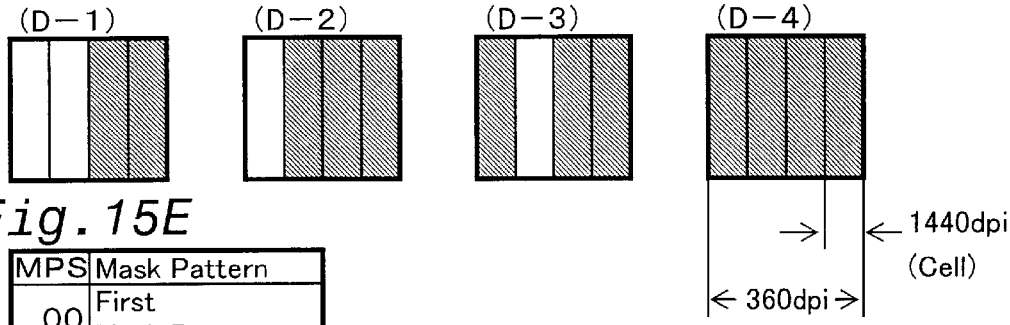

Fig. 15E

| MPS | Mask Pattern |
|---|---|
| 00 | First Mask Pattern |
| 01 | Second Mask Pattern |
| 10 | Third Mask Pattern |
| 11 | Fourth Mask Pattern |

Fig. 15F

| DTS | First Mask Pattern | Second Mask Pattern | Third Mask Pattern | Fourth Mask Pattern |
|---|---|---|---|---|
| 00 | (A−1) | (B−1) | (C−1) | (D−1) |
| 01 | (A−2) | (B−2) | (C−2) | (D−2) |
| 10 | (A−3) | (B−3) | (C−3) | (D−3) |
| 11 | (A−4) | (B−4) | (C−4) | (D−4) |

*Fig. 16A*

Original Masking Signal Data Contained in First Mask Pattern

| | (A−1) | (A−2) |
|---|---|---|
| Forward Pass | 0 0 0 0 | 1 1 1 1 |
| Return Pass | 0 0 0 0 | 1 1 1 1 |

*Fig. 16B*

Original Masking Signal Data Contained in Second Mask Pattern

| | (B−1) | (B−2) |
|---|---|---|
| Forward Pass | 0 0 0 1 | 0 1 1 1 |
| Return Pass | 1 0 0 0 | 1 1 1 0 |

*Fig. 16C*

Original Masking Signal Data Contained in Third Mask Pattern

| | (C−1) | (C−2) |
|---|---|---|
| Forward Pass | 1 0 0 0 | 1 1 1 0 |
| Return Pass | 0 0 0 1 | 0 1 1 1 |

*Fig. 16D*

Original Masking Signal Data Contained in Fourth Mask Pattern

| | (D−1) | (D−2) |
|---|---|---|
| Forward Pass | 0 1 1 0 | 0 1 1 0 |
| Return Pass | 0 1 1 0 | 0 1 1 0 |

Pixel Interval (360 dpi)

ODRV
W0

PRT(i)
(for Small Dots)
L
H
L

PRT(i)
(for Medium Dots)
L
H
L

PRT(i)
(for Large Dots)
H

PRT(i)
(for Small Dots)

PRT(i)
(for Medium Dots)

PRT(i)
(for Large Dots)

For Photographs (2 Bits)

When pixel value is 0

When pixel value is 1

Small Dot

When pixel value is 2

Medium Dots

When pixel value is 3

Large Dots

For Text (1 Bit)

When pixel value is 0

When pixel value is 1

Large Dots

Fig.25A

Third Embodiment

| Print Mode Parameters<br>Type of Image | Smoothing Routine |
|---|---|
| Text | Needed |
| Photo | Unneeded |

Fig.25B

Fourth Embodiment

| Print Mode Parameters | | Smoothing Routine |
|---|---|---|
| Type of Image | Print Resolution | |
| Text | High (High-Quality) | Unneeded |
| | Low (High-Speed) | Needed |
| Photo | Low (High-Speed) | Unneeded |
| | High (High-Quality) | |

Fig.25C

Fifth Embodiment

| Print Mode Parameters | | | Smoothing Routine |
|---|---|---|---|
| Type of Image | Print Resolution | Print Medium | |
| Text | High (High-Quality) | Plain Paper | Unneeded |
| | | Special Paper | |
| | Low (High-Speed) | Plain Paper | First Smoothing Routine |
| | | Special Paper | Second Smoothing Routine |
| Photo | High (High-Quality) | Plain Paper | Unneeded |
| | | Special Paper | |
| | Low (High-Speed) | Plain Paper | |
| | | Special Paper | |

When smoothing routine is performed

When pixel value is 0

When pixel value is 1

PRINTING APPARATUS AND METHOD IMPLEMENTING SMOOTH OUTLINE

BACKGROUND OF THE INVENTION

1. Field of the Invention

This invention relates to a technique for printing images on a printing medium by ink injection.

2. Description of the Related Art

In recent years, color printers of the type in which inks of multiple colors are ejected from an ink head have become popular as output devices for computers and are now widely used in processes in which images processed by computers are printed in numerous colors and gradations. Such printers are usually provided with improved print resolution in order to allow text and other line drawings to be printed with good results.

However, improving print resolution is accompanied by an increase in the amount of data being processed. The resulting drawback is that, in particular, considerable time is needed to transfer data between computers and printing apparatus, resulting in reduced printing speed.

SUMMARY OF THE INVENTION

Accordingly, an object of the present invention is to smooth the outlines of line drawings while minimizing the reduction in printing speed.

In order to attain the above and the other objects of the present invention, there is provided a printing apparatus capable of selectively forming any of N types of dot recording states which are different in an ink amount and/or in an ink-deposited position in a pixel area on a print medium. N is an integer of 2 at least. The printing apparatus comprises a print head, a receiver, a dot selector, and a drive signal generator. The print head has a plurality of nozzles and a plurality of ejection drive elements for ejecting ink drops from corresponding plurality of nozzles. The receiver is configured to receive print data from an external device, the print data containing gradation data indicative of M values for each pixel in a printed image. M is a positive integer of (N−1) at most. The dot selector is configured to select one type of dot recording state for each pixel from the N types of dot recording states in response to the print data. The selected type of dot recording state is smoothing an outline contained in a printed image. The drive signal generator is configured to generate drive signals for driving the ejection drive elements to form the selected type of dot recording state.

As used herein, the term "dot recording state" has a broad meaning that includes states in which dots may or may not be recorded.

The gradation data received by a printing apparatus from an external device has M gradations (where M is an integer of (N−1) or less), so these gradation data alone can only reproduce a maximum of (N−1) dot-forming states. A dot selector selects a recording state from among those having N types of dots on the basis of these gradation data. In the specific case in which the gradation data received from an external device are binary data, the dot selector selects a state in which no dots are formed when the gradation value is zero, and selects a small or large dot when the gradation value is one.

Therefore, the first printing apparatus of the present invention allows images to be reproduced using a greater number of types of dot recording states in comparison with that provided by the gradation data received from an external device. It is therefore possible to smooth image outlines while minimizing the increase in data transmission from the external device.

In the printing apparatus of the present invention, the N types of dot recording states include at least one dot recording state which is identical to another in the ink amount and different in the ink-deposited position.

Therefore, the outlines of line drawings can be smoothed even by using dots created using the same amounts of ink but formed at different locations.

In a preferred embodiment of the invention, a number of bits per pixel in the gradation data is less than a number of bits per pixel in data indicative of the N types of dot recording states.

Adopting this approach makes it possible to minimize the increase in data transmission from an external device.

In a preferred embodiment of the invention, the dot selector is configured to select one dot recording state for each pixel to smooth an outline contained in the printed image based on a gradation value of the each pixel and a gradation value of a pixel adjacent to the each pixel according to the gradation data.

With this approach, the dot type can be selected with consideration for the gradation values of pixels adjacent to each pixel, making it possible to easily minimize the jaggies commonly developed by line drawings.

In a preferred embodiment of the invention, the drive signal generator comprises an original drive signal generator and an original drive signal shaper. The original drive signal generator is configured to generate an original drive signal having a plurality of pulses within a main scan period for a single pixel. The original drive signal is commonly applicable to the plurality of ejection drive elements. The original drive signal shaper is configured to shape the original drive signal with a masking signal to generate the drive signal. The drive signal is configured to represent any of the N types of dot recording states. The original drive signal shaper comprises a mask pattern storage, a mask pattern selector, a masking signal generation circuit, and a masking unit. The mask pattern storage is configured to store a plurality of mask patterns. Each mask pattern contains a plurality of types of original masking signal data to be used for generating the masking signal. The mask pattern selector is configured to select one mask pattern from the plurality of mask patterns in response to the selection of the dot recording state. The selected mask pattern is capable of reproducing the selected dot recording state. The masking signal generation circuit is configured to select one original masking signal data from the plurality of types of original masking signal data contained in the selected mask pattern in response to the selection of the dot recording state, and also to generate the masking signal with the selected original masking signal data. The masking unit is configured to selectively mask the plurality of pulses in the original drive signals with the masking signals, to thereby generate the drive signal provided to the each ejection drive element.

With this approach, a printing apparatus in which mask patterns are used to control dot size can be employed with ease.

In a second embodiment, there is provided a printing apparatus capable of selectively forming any of N types of dot recording states which are different in an ink amount and/or in an ink-deposited position in a pixel area on a print medium. N is an integer of 2 at least. The printing apparatus comprises a print head, a receiver, a dot selector, a font processor, and a drive signal generator. The print head has a plurality of nozzles and a plurality of ejection drive elements for ejecting ink drops from corresponding plurality of nozzles. The receiver is configured to receive print data from an external device. The print data contains text-specifying data for specifying at least a text to be recorded and gradation data indicative of a gradation value of each of first pixels in a printed image other than text. The dot selector is configured to select one type of dot recording state from the N types of dot recording states in response to the print data. The selected type of dot recording state is to be recorded for each of the first pixels. The font processor is configured to store a scalable font data and also to define gradation values of each of second pixels in response to the text-specifying information and the scalable font data. The second pixels are corresponding to a higher resolution than that of the gradation data. The scalable font data contains data indicative of a text shape in a form of vector information. The drive signal generator is configured to generate drive signals for driving the ejection drive elements to form the selected type of dot recording state. The dot selector selects one type of dot recording state from the N types of dot recording states in response to an arrangement of gradation values of the second pixels within the first pixel. The selected type of dot recording state is best suited for expressing the arrangement of the gradation values.

According to the second embodiment of the present invention, gradation values are established for a second pixel with a higher resolution than that afforded by the gradation data in accordance with text-specifying information, and dots are selected such that their configuration is best suited for expressing the manner in which the gradation data of gradation values are arranged within the first pixels, making it possible to print smoothly outlined texts. As a result, it is possible to smooth text outlines while minimizing the increase in print data when, for example, mixed images consisting of text and natural images are printed.

In a preferred embodiment of the invention, the drive signal generator comprises an original drive signal generator and an original drive signal shaper. The original drive signal generator is configured to generate an original drive signal having P pulses within the main scan period of a single pixel. P is an integer of 2 at least. The original drive signal is commonly applicable to the plurality of ejection drive elements. The original drive signal shaper is configured to shape the original drive signal with a masking signal, thereby generating drive signals configured to represent any of $2^P$ kinds of dot recording states. $2^P$ denotes the P-th power of 2. The font processor defines the gradation values in the second pixels corresponding to a resolution. The resolution is P times as greater as a resolution of the gradation data. The original drive signal shaper comprises a mask pattern storage, a mask pattern selector, a masking signal generation circuit, and a masking unit. The mask pattern storage is configured to store a plurality of mask patterns. Each mask pattern containing a plurality of types of original masking signal data to be used for generating the masking signals. The mask pattern selector is configured to select one mask pattern from the plurality of mask patterns in response to the selected type of dot recording state. The selected mask pattern is capable of reproducing the selected type of dot recording state. The masking signal generation circuit is configured to select one type of original masking signal data from the plurality of types of original masking signal data contained in the selected mask pattern in response to the selected type of dot recording state, and also to generate the masking signal with the selected type of original masking signal data. The masking unit is configured to selectively mask the P pulses in the original drive signals with the masking signals, to thereby generate the drive signal provided to the each ejection drive element.

Adopting this approach allows resolution to be substantially enhanced in the direction of main scanning in the case of text expression alone, making it possible, for example, to print text alone (for which resolution has priority over the number of gradations) with high resolution and at the same time to print natural images (for which the number of gradations has priority over resolution) when, for example, the natural images are printed as mixed images.

In a preferred embodiment, the printing apparatus comprises a main body and a carriage. The main body is of the printing apparatus. The carriage is configured to move in a main scan direction, and also to carry the print head, the masking signal generator, and the masking unit. The printing apparatus transmits data for the mask pattern selection and data for the original masking signal selection from the main body to the carriage in parallel.

An advantage of this approach is that the reduction in printing speed that accompanies an increase in the volume of data in the printing apparatus can be minimized because less time is needed to transfer print signals to the print head.

In a preferred embodiment of the invention, the printing apparatus has a bidirectional printing function for printing during both forward and return passes of main scan, and stores the plurality of mask patterns in the mask pattern storage. The plurality of mask patterns are stored such that reversed original masking signal data are selected for forward and return passes, respectively.

An advantage of this approach is that a smoothly outlined text can be expressed even when bidirectional printing is performed.

According to a preferred embodiment, integer N is 2 or 3, and integer M is 2.

In a third embodiment, there is provided a printing apparatus for printing by ejecting ink drops from a print head to form dots. The apparatus comprises a print mode selector and a smoothing processor. The a print mode selector allows a user to select one of a plurality of print modes including a specific text print mode suitable for printing text documents, and a photographic print mode suitable for printing photographic images. The smoothing processor is configured to perform a smoothing process in order to smooth an outline contained in a printed image when the specific text print mode is selected, and also to dispense with the smoothing process when the photographic print mode is selected.

According to the third embodiment of the present invention, a smoothing process is carried out only when a specific text print mode is selected in accordance with the printing mode specified by the user, making it possible, for example, to achieve a result in which performing the smoothing process allows the outlines of printed images to be smoothed by this routine during printing while preventing the picture quality of photographs from being degraded.

In a preferred embodiment of the invention, the printing apparatus further comprises a print head driver and a print data generator. The print head driver configured to form any of N types of dots selectively with each nozzle. The N types of dots is different in size in a single pixel area on a print medium. N is an integer of 2 at least. The print data generator is configured to generate print data indicative of a state of dot formation in each pixel in response to the print mode selection. The print data generator composes the print data with binary pixel values indicative of presence or absence of the dot formation in each pixel when the specific text print mode is selected, and also composes the print data with multiple pixel values indicative of a state of dot formation in each pixel when the photographic mode is selected. When the specific text print mode is selected, the smoothing processor selects one type of dot from the N types of dots for each pixel in response to the binary pixel value for the each pixel and the binary pixel value for a pixel adjacent to the each pixel.

With this approach, the function of selecting any desired dot type from among a plurality of dot types with different sizes in the area occupied by a single pixel can be adapted both to outline smoothing during text printing and to picture quality enhancement during the printing of photographic images.

In a preferred embodiment of the invention, the print head driver is capable of ejecting ink drops at a plurality of different positions within the pixel area on a print medium. When the specific text print mode is selected, the smoothing processor selects ink-ejected position from the plurality of different positions within the pixel area in response to the binary pixel value for the each pixel and the binary pixel value for a pixel adjacent to the each pixel.

An advantage of this approach is that the outlines of a printed image can be further smoothed by selecting appropriate positions for ejecting ink drops.

In a preferred embodiment of the invention, print mode parameters selectable by the user include a type of print medium. When the specific text print mode is selected, the smoothing processor selects ink-ejected position from the plurality of different positions within the pixel area in response to the type of print medium, the binary pixel value for the each pixel, and the binary pixel value for a pixel adjacent to the each pixel.

The positions in which ink drops are ejected to smooth the outlines sometimes vary with the type of print medium. In such cases, an optimum smoothing process for the selected print medium can be performed by varying the specifics of the smoothing process in accordance with the print medium.

In a preferred embodiment of the invention, print mode parameters selectable by the user include ink color. The smoothing processor is configured to perform the smoothing process for each color of inks when the specific text print mode involving use of color inks is selected.

An advantage of this approach is that the outlines of printed images can be smoothed not only in the case of black text but also in the case of color text.

In a fourth embodiment, there is provided a printing control apparatus for generating print data to be supplied to a printing unit to perform printing by ejecting ink drops from a print head to form dots. The print mode selector allows a user to select one of a plurality of print modes including a specific text print mode suitable for printing text documents, and a photographic print mode suitable for printing photographic images. The print data generator is configured to generate print data containing smoothing command information if the specific text print mode is selected, and also generate the print data devoid of the smoothing command information if the photographic print mode is selected. The smoothing command information commands the printing unit to perform smoothing process for smoothing an outline contained in a printed image.

According to the fourth embodiment of the present invention, print data containing information on smoothing commands are created in accordance with the print mode selected by the user, and because the information on smoothing commands is designed to allow smoothing processs to be performed by a printing unit. This approach also makes it possible to smooth the outlines of printed images by performing smoothing during textual printing while preventing print quality from degrading during photograph printing in the same manner as with the first approach.

In a fifth embodiment, there is provided a printing apparatus for printing by ejecting ink drops from a print head and forming dots in response to supplied printing data, comprising. The smoothing processor is configured to perform a smoothing process if the print data contains smoothing command information, and NOT to perform the smoothing process if the data does not contain the smoothing command information, the smoothing command information indicating that the smoothing process is to be performed to smooth an outline contained in a printed image.

According to the fifth embodiment of the present invention, it is determined whether smoothing is to be performed in accordance with whether information on smoothing commands is contained in the print data supplied, and the information on smoothing commands is included into the print data in accordance with the print mode, allowing this approach to deliver the same effect as the first approach.

The present invention can be realized in various forms such as a method and apparatus for printing, a method and apparatus for producing print data for a printing unit, and a computer program product implementing the above scheme.

BRIEF DESCRIPTION OF THE DRAWINGS

FIGS. 6A–6C are diagrams depicting the relation between the gradation values of print data and the states of dots in each pixel;

FIGS. 8A–8D are diagrams illustrating the method for generating a print signal PRT in accordance with the first embodiment of the present invention;

FIGS. 9A–9E are timing charts depicting an example of operation of the drive signal generator 306 in accordance with the first embodiment of the present invention;

FIGS. 10A–10B are diagrams depicting the truth table of a masking signal generation circuit in a state in which a masking signal MSK(i) is obtained in accordance with the first embodiment of the present invention;

FIGS. 11A–11B are diagrams depicting the truth table of a masking signal generation circuit in a state in which a masking signal MSK(i) is obtained in accordance with the first embodiment of the present invention;

FIGS. 15A–15F are diagrams illustrating a method for improving the true resolution by switching mask patterns in accordance with the second embodiment;

FIGS. 16A–16D are diagrams depicting the original masking signal data stored in the mask pattern storage during forward and return passes;

FIGS. 25A–25C are diagrams depicting a plurality of examples of a method for setting the smoothing process in step S4.

DESCRIPTION OF THE PREFERRED EMBODIMENTS

Embodiments of the present invention will now be described through embodiments in the following sequence.

Figure 1:
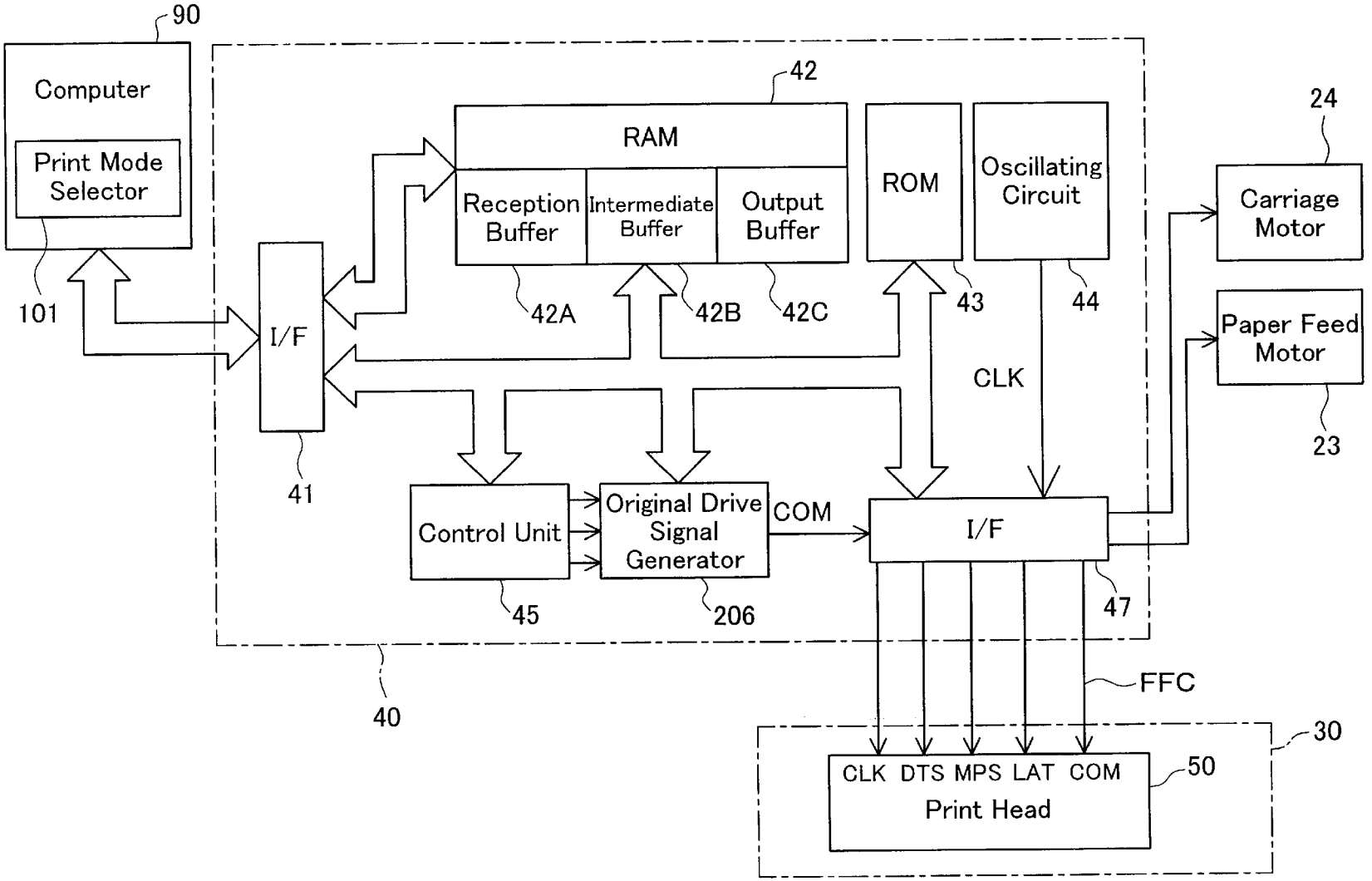
FIG. 1 is a block diagram depicting the entire structure of the printing apparatus of the present invention.

A. Overall Structure of Printing apparatus
B. First Embodiment of Present Invention
C. Second Embodiment of Present Invention
D. Third Embodiment of Present Invention
E. Fourth Embodiment of Present Invention
F. Fifth Embodiment of Present Invention
G. Modifications A. Overall Structure of Printing Apparatus FIG. 1 is a block diagram depicting the entire structure of the printing apparatus according to the present invention. The printing apparatus comprises a control circuit 40, a paper feed motor 23, a carriage motor 24 for main scanning, and a print head 50 with a mounted carriage 30, as shown in FIG. 1. The printing apparatus is connected to a computer 90, which serves as a external device for the printing apparatus.

The computer 90 runs application programs under a specific operating system. A Video driver and a printer driver are incorporated into the operating system to allow images to be displayed or various video routines to be performed. The computer 90 is provided with a print mode selector 101 for allowing the user to select print modes (including a text mode). Its functions are described below.

The control circuit 40 comprises an interface 41 for receiving print signal and so on from the computer 90, a RAM 42 for storing various types of data, a ROM 43 containing routines for various types of data processing, an oscillating circuit 44, a control unit 45 composed of a CPU and the like, an original drive signal generator 206, and an interface 47 for sending print signals or drive signals to the paper feed motor 23, carriage motor 24, or print head 50.

RAM 42 is used as a reception buffer 42A, intermediate buffer 42B, or output buffer 42C. The print data PD from the computer 90 are stored in the reception buffer 42A via the interface 41. These data are converted to an intermediate code and are stored in the intermediate buffer 42B. The print data PD received from the computer 90 contain gradation data that express the gradation value of each pixel.

The control unit 45 processes gradation data in a specific manner (see below) and creates mask pattern selection data MPS. The gradation data and the mask pattern selection data are stored in the output buffer 42C. The output buffer 42C is connected to the print head 50 via the interface 47 and an FFC (Flexible Flat Cable). The FFC can cover the considerable distance between the print head 50 and the control circuit 40 and can deform in conformity with the movements of the carriage 30 on which the print head 50 is mounted.

In the present specification, the portion of the printing apparatus other than the carriage 30 or the FFC will be referred to as a "printing apparatus main body," or merely a "main body." As used herein, the term "printing apparatus main body" refers to a portion that is different from the carriage 30 and requires no movement to perform printing operations.

Figure 2:
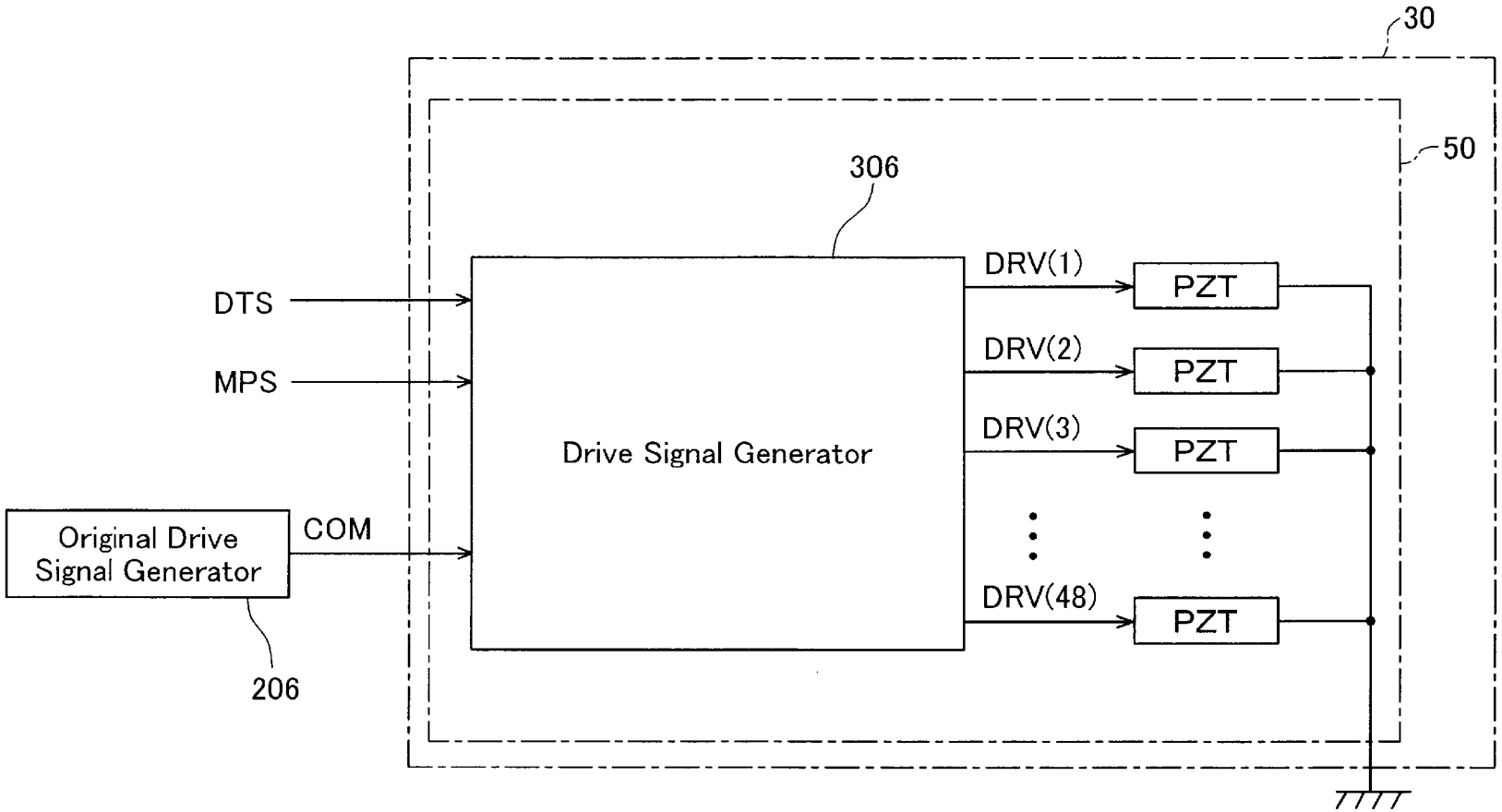
FIG. 2 is a block diagram depicting the structure of a print head 50 in accordance with a first embodiment of the present invention.

FIG. 2 is a block diagram depicting the structure of the print head 50 in accordance with a first embodiment of the present invention. The print head 50 comprises a drive signal generator 306 and ejection drive elements PZT for ejecting ink drops from the nozzles. The drive signal generator 306 generates a drive signal DRV(i) for each nozzle by a method in which the original drive signal COM received from the original drive signal generator 206 is shaped in accordance with the gradation data and mask pattern selection data MPS. The drive signal DRV(i) is sent to the ejection drive elements PZT, and the nozzles eject ink drops in accordance with this signal.

Figure 3:
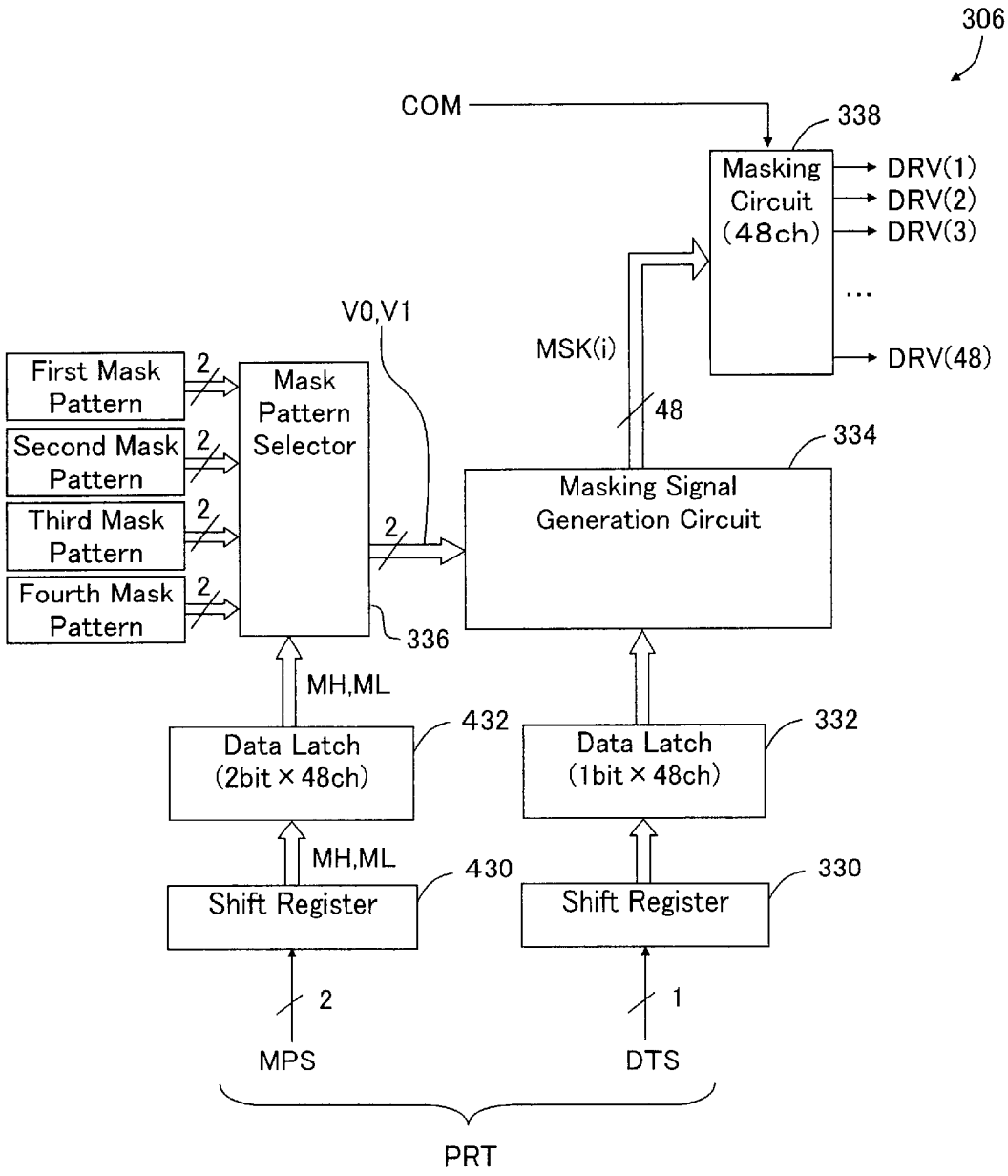
FIG. 3 is a block diagram depicting the inner structure of a drive signal generator 306 in accordance with the first embodiment of the present invention.

FIG. 3 is a block diagram depicting the inner structure of the drive signal generator 306. The drive signal generator 306 comprises shift registers 330 and 430, data latches 332 and 432, a masking signal generation circuit 334, a mask pattern selector 336, and a masking circuit 338. In the drive signal generator 306, the gradation data are used as dot type selection data DTS.

The shift register 430 converts the mask pattern selection data MPS to parallel data (2 bits×48 channels). As used herein, "one channel" refers to a signal corresponding to a single nozzle. The mask pattern selection data MPS corresponding to a single pixel of a single nozzle comprise two bits: an upper bit MH and a lower bit ML. The mask pattern selector 336 selects one of four mask patterns in accordance with the 2-bit mask pattern selection data MPS (MH, ML) of each channel. The mask pattern selector 336 presents the masking signal generation circuit 334 with the original masking signal data V0 and V1 containing the mask pattern thus selected. According to the present embodiment, signal lines are provided for each channel inside the FCC between the print head 50 and the control circuit 40 to prevent signal transfer speed from decreasing.

The shift register 330 converts the dot type selection data DTS (gradation data) to parallel data (1 bit×48 channels).

Unlike the mask pattern selection data MPS, the dot type selection data DTS corresponding to a single pixel of a single nozzle consist of a single bit. The masking signal generation circuit 334 creates a 1-bit masking signal MSK(i) (where i=1 to 48) for each channel in accordance with the original masking signal data V0 and V1 obtained from the mask pattern selector 336 and the 1-bit dot type selection data DTS for each channel, as described above. One type of dot is created in accordance with the masking signal MSK(i) thus created. Therefore, the function of the dot type selection data DTS is to allow the type of dots used to form each pixel to be selected from among the dots that can be formed using each mask pattern.

The masking circuit 338 is a switching circuit designed to mask all or part of the signal waveform inside a single pixel interval of the original drive signal COM in accordance with the masking signal MSK(i) thus received. The structure and operation of the mask pattern selector 336 and the masking signal generation circuit 334 are described below.

B. First Embodiment of Present Invention

Figure 4:
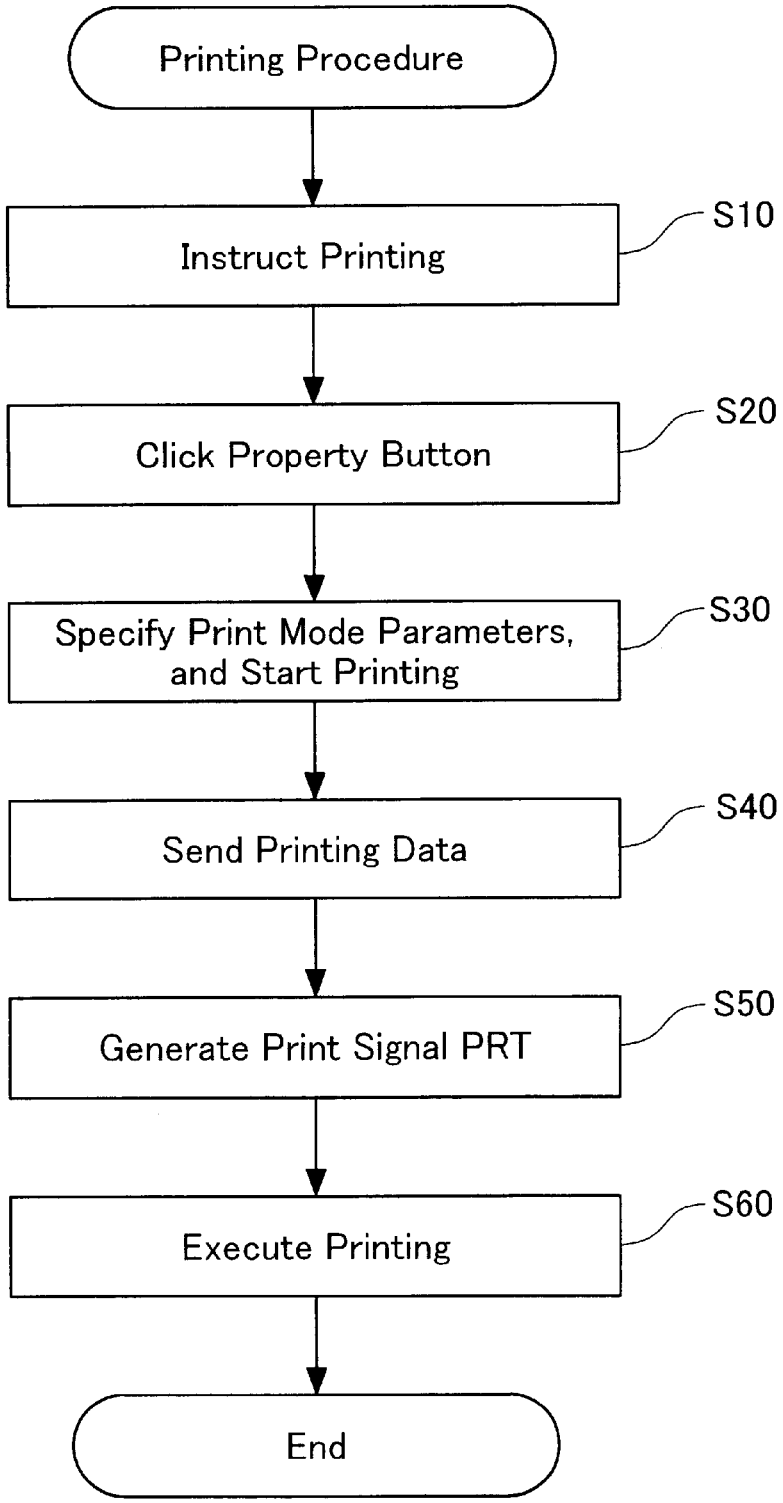
FIG. 4 is a flowchart depicting the sequence adopted to perform a printing procedure in accordance with the first embodiment of the present invention.
Figure 5:
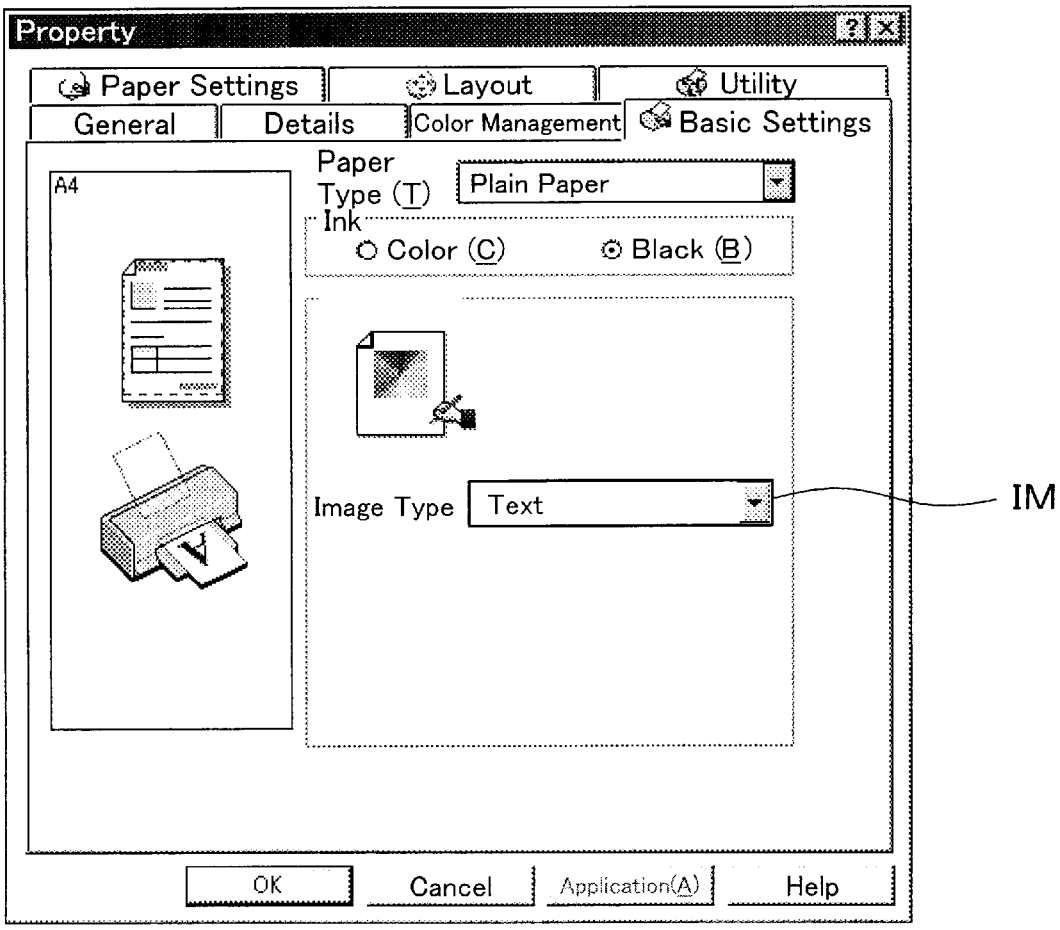
FIG. 5 is a diagram depicting an example of a basic settings screen for displaying print modes on a CRT 21.

FIG. 4 is a flowchart depicting the sequence adopted to perform a printing procedure in accordance with a embodiment of the present invention. In step S10, the user instructs the computer 90 to start printing. When the property box (not shown) in the print dialog box displayed on the CRT 21 is clicked in step S20, the print mode selector 101 (FIG. 1) displays the property settings screen (FIG. 5) on the CRT 21.

The user can indicate a variety of parameters for specifying the print mode on the property settings screen. The basic settings screen for print modes in FIG. 5 has a menu for specifying a variety of parameters, including an image type selection menu IM. The image type selection menu IM is a pull-down menu for selecting one type of image from a list of image types such as text and photographs.

The user can also set other parameters on the screen for setting the details of print modes, but the description of these other parameters will be foregone with respect to the present embodiment.

When the user selects the image type and instructs printing to be started in step S30 (FIG. 4), the print data PD are sent to the control circuit 40 from the computer 90 (S40). The print data PD comprises gradation data and information about print modes. It is assumed herein that the gradation data are binary data with a resolution of 360 dpi in the direction of main scanning and 360 dpi in the direction of sub-scanning.

In step S50, the control unit 45 creates a print signal PRT by processing the gradation data. The gradation data are converted directly to dot type selection data DTS, and these provide the print signal PRT when the print mode is different from a text print mode. When the print mode is a text print mode, smoothing is performed and a print signal PRT is created as a combination of mask pattern selection data MPS and dot type selection data DTS.

FIGS. 6A–6C are diagrams depicting the relation between the gradation values of print data and the shape of dots in each pixel following smoothing. FIG. 6A shows the gradation values for each pixel. In this example, it is assumed that black text is printed, and the gradation values are binary values (0 or 1). FIGS. 6B and 6C show the dot configuration states obtained when smoothing is performed using two different procedures. The dark portions represent cells covered with ejected ink drops.

In a hypothetical example, the following information is recorded on a print medium, assuming that no smoothing is performed. No dots are formed in pixels whose gradation value is 0, and four ink drops are ejected onto pixels whose gradation value is 1. Specifically, a recording similar to the one formed by the pixels in column a, row 1 in FIGS. 6A–6C will be produced when the gradation value is 0, and a recording similar to the one formed by the pixels in column a, row 3 in FIG. 6B will be produced when the gradation value is 1.

Therefore, sawtooth-type indentations (jaggies) sometimes result when recording is performed without any smoothing. In the example shown in FIG. 6A, an abrupt step is present between column b and column c. Specifically, the gradation value of column b, row 2 is 0, whereas the gradation value of column c, row 2 on the right is 1, so no dots are formed in the pixel in column b, row 2 whereas four ink drops are ejected onto the pixel in the adjacent column c, row 2, producing an abrupt step there. Therefore, the number of ink drops deposited onto adjacent pixels abruptly increases from 0 to 4. This abrupt change is registered by the human eye as steep variations in blackness. Such variations are referred to as "jaggies." The smoothing of the present embodiment is performed to smooth such jaggies.

Described below are the specifics of a smoothing process performed as described with reference to FIG. 6B. In the absence of smoothing, no dots are formed in the pixel in column b, row 2 with a gradation value of 0, whereas performing smoothing causes a single ink drop to be ejected onto the pixel along the right-hand edge, as is the case with the pixel disposed in column b, row 2 in FIG. 6B. In the case of the pixel in column c, row 2 with a gradation value of 1, four ink drops are ejected in the absence of smoothing, and two ink drops are ejected in the central area if smoothing is performed. As a result, the number of ink drops thus ejected changes by one from column b, row 2 to column c, row 2 if smoothing is performed. This change is less than the four-drops change occurring in the absence of smoothing.

The number of ink drops ejected in columns a to g, row 2 varies in the following order: 0, 0, 4, 4, 4, 0, 0 from column a when no smoothing is performed, and 0, 1, 2, 4, 2, 1, 0 from column a when smoothing is performed. It can thus be seen that the jaggies are reduced because the amount of ink varies only slightly. In addition, ink drops are ejected at a position corresponding to the right-hand edge inside the pixel in column b, row 2, and ink drops are ejected at a position corresponding to the left-hand edge inside the pixel in column f, row 2. Since the amount of ink varies only slightly with the ejection position of ink drops in the above-described manner, this type of processing yields even smoother outlines than when the amount of ink is merely adjusted by selecting the appropriate ejection positions for the ink drops.

In the example shown in FIG. 6B, the number of ink drops in column c, row 3 is reduced by one in comparison with the case in which no smoothing is performed. This is done in order to further reduce the abrupt step from column b to column c. The same type of processing can be performed on the pixels in column e, row 3.

FIG. 6C depicts another smoothing example. The specifics of an optimum routine designed to smooth the outlines of a printed image may, for example, vary with the print medium or ink characteristics. It is more preferable in such cases to be able to use a plurality of smoothing process in accordance with the print medium or ink characteristics, and to make the selection in accordance with the print mode parameters.

Figure 7A:
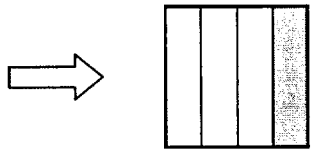
FIGS. 7A–7C are diagrams illustrating the smoothing method in accordance with the first embodiment of the present invention.
Figure 7B:
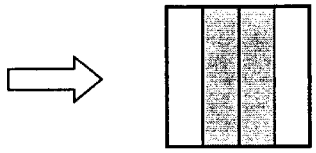
Figure 7C:
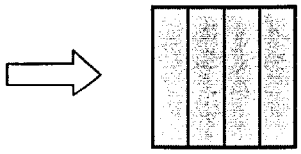

FIGS. 7A–7C are diagrams illustrating the smoothing method in accordance with the first embodiment of the present invention. In this example, the positions at which ink drops are ejected are determined based on the gradation values of the pixels to be recorded and on the gradation values of adjacent pixels. As shown, for example, in FIG. 7A, the positions at which ink drops are ejected in column b, row 2 are determined based on the gradation values of the pixels in column b, row 2 and the gradation values of the eight surrounding pixels. The positions at which ink drops are ejected in column c, row 2 and column d, row 2 are determined in the same manner, as shown in FIGS. 7B and 7C.

FIGS. 8A–8C are diagrams illustrating the method for generating a print signal PRT in accordance with the first embodiment of the present invention. FIGS. 8A to 8D depict dot types that can be formed by the mask patterns selected in accordance with the mask pattern selection data MPS. For example, a first mask pattern is selected if the mask pattern selection data MPS are "00." The dot types that can be formed by the first mask pattern are the dots shown (A-0) and (A-1) of FIGS. 8A. Of these, the dots shown in (A-0) are formed when the dot type selection data DTS are zeros, and the dots shown in (A-1) are formed when the dot type selection data DTS are ones. The same types of dots can be formed independently from the dot type selection data DTS when the mask pattern selection data MPS are "11," as shown in FIG. 8D.

The print signal PRT is generated by the control unit 45 as a combination of dot type selection data DTS and mask pattern selection data MPS. For example, the result is 0 in the case shown in FIG. 7A because the gradation value of the pixels to be recorded is also 0. The mask pattern selection data MPS are set to "01" to make it possible to select a second mask pattern capable of forming the dot types selected as shown in FIG. 7A. Therefore, the control unit 45 functions as the dot selector referred to in the claims.

The print signal PRT (combination of mask pattern selection data MPS and dot type selection data DTS) is sent to the print head 50 via the FFC. The print head 50 ejects ink drops onto the print medium in accordance with the print signal PRT thus obtained (step S60).

When the print mode is not a text print mode, printing is carried out using a first mask pattern (set as the default) without the use of the mask pattern selection data MPS.

FIGS. 9A–9E are timing charts depicting an example of operation of the drive signal generator 306. The operation entails forming a drive signal DRV for producing two types of dots created using a second mask pattern. FIG. 9A depicts the original drive signal COM outputted by the original drive signal generator 206. It can be seen from the drawing that the original drive signal COM of the present embodiment contains four pulses W0 with identical waveforms in the four cells constituting a single pixel interval. In the present specifications, "pixel" refers to the smallest unit constituting an image expressed by the gradation data contained in the print data presented from the outside, and "single pixel interval" refers to the period of the original drive signal used to reproduce a dot corresponding to a single pixel.

FIGS. 9B and 9C depict a first masking signal MSK(i) for forming a first dot type, and a second masking signal MSK(i) for forming a second dot type. These signals are outputted from the masking signal generation circuit 334 (FIG. 3) and are designed to control the masking circuit 338. The masking circuit 338 functions as a switch interposed between the original drive signal generator 206 and the ejection drive elements PZT, making it possible to selectively transmit the four pulses W0 in a single pixel interval. The masking circuit 338 is an analog switch that transmits the original drive signal COM when the masking signal MSK(i) is 1, and blocks the original drive signal COM when the masking signal MSK(i) is 0.

Each masking signal MSK(i) assumes a value of 1 or 0 in each of the cells of a single pixel interval. The first masking signal MSK(i) (FIG. 9B) assumes the value of 0 in the first to third cells, and the value of 1 in the second to fourth cells.

FIGS. 9D and 9E depict the drive signals DRV(i) outputted by the masking circuit 338. The drive signals DRV(i) are generated by allowing the original drive signal COM to pass only when the masking signal MSK(i) is 1, as described above. Consequently, the first drive signal (FIG. 9F) contains a pulse W0 solely in the fourth cell, and the second drive signal (FIG. 9G) contains pulses W0 in the second to fourth cells.

The drive signals DRV are sent to the ejection drive elements PZT, and cause ink drops to be ejected from the nozzles. Specifically, the ink drops are ejected in the fourth cell in accordance with the first drive signal to form the first type of dot, and are ejected in the second to fourth cells in accordance with the second drive signal to form the second type of dot.

FIGS. 10A–10B are diagrams depicting the truth table of a masking signal generation circuit 334 (FIG. 3) in a state in which a masking signal MSK(i) is obtained using the first or second mask pattern. FIG. 10B depicts a truth table obtained using the second mask pattern. During intervals T21–T24, the first original masking signal data V0 contained in the second mask pattern vary as follows: 0, 1, 1, 1. The second original masking signal data V1 vary as follows: 0, 0, 0, 1.

The masking signal generation circuit 334 is configured such that the level of the masking signal MSK(i) is caused to vary in the same manner as the level of the first original masking signal data V0 when the dot type selection data DTS have a value of 1. As a result, the masking signal generation circuit 334 generates a masking signal MSK(i) that assumes the values 0, 1, 1, and 1 during periods T21–T24. All these values agree with the values of the masking signal MSK(i) shown in FIG. 9C. Similarly, the manner in which the masking signal MSK(i) varies when the value of the dot type selection data DTS is 0 in FIG. 10B is kept identical to the one shown in FIG. 9B.

FIG. 10A depicts a truth table obtained using the first mask pattern. The original masking signal data V0 and V1 contained in the first mask pattern differ from original masking signal data V0 and V1 contained in the second mask pattern, as can be seen in FIG. 10A. FIGS. 11A and 11B depict truth tables obtained using third and fourth mask patterns, which are also different from each other.

Figure 12:
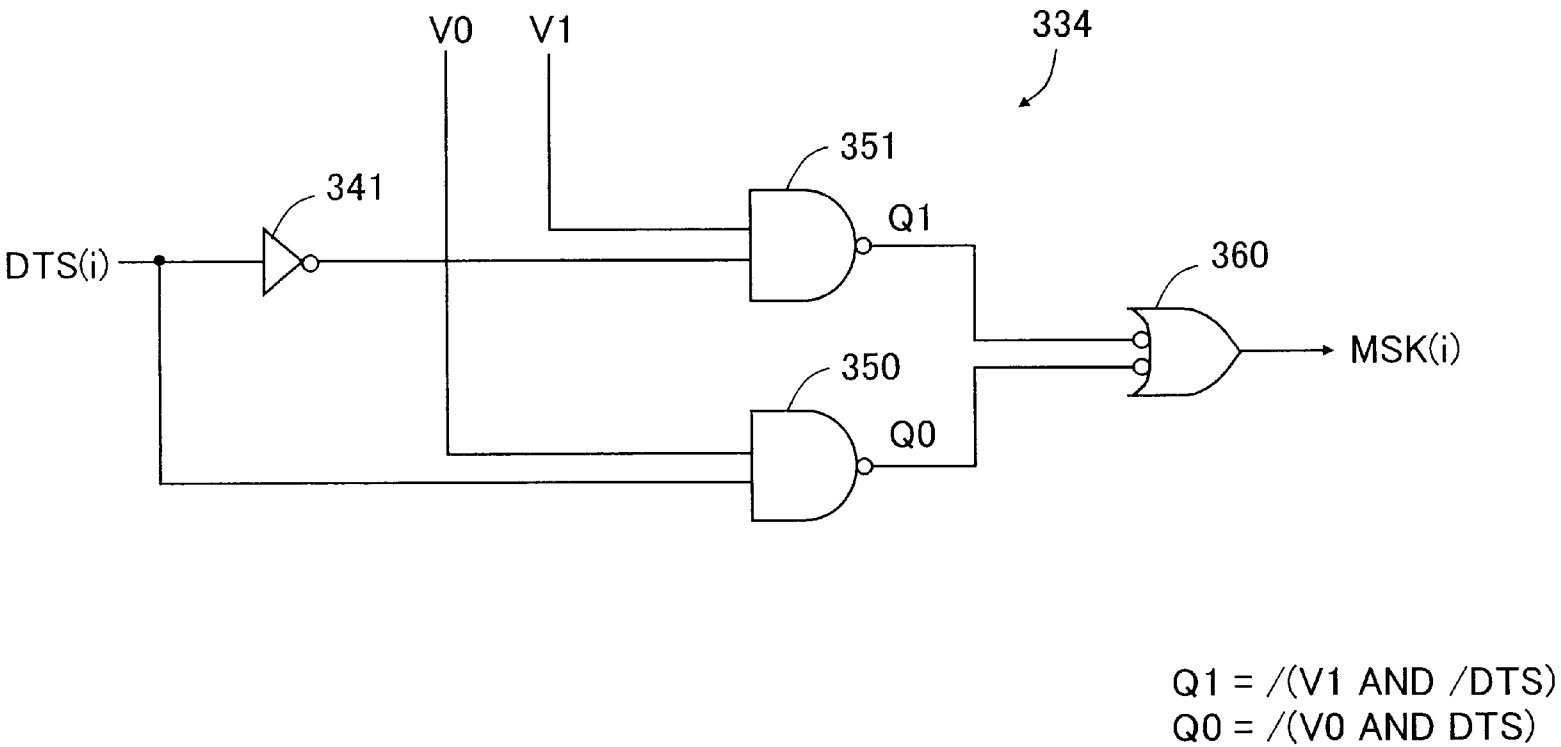
FIG. 12 is a block diagram depicting the inner structure of the masking signal generation circuit in accordance with the first embodiment of the present invention.

FIG. 12 is a block diagram depicting the inner structure of the masking signal generation circuit 334. The masking signal generation circuit 334 comprises an inverter 341, two NAND circuits 350 and 351 for performing logic operations with respect to the dot type selection data DTS and either one of the original masking signal data V0 and V1, and a NAND circuit 360 for outputting the masking signal MSK (i).

The two NAND circuits 350 and 351 are connected such that their respective outputs Q0 and Q1 can be rewritten as theoretical formulas (1) and (2) below.

$$Q0=/(V0 \text{ AND } DTS) \quad (1)$$

$$Q1=/(V1 \text{ AND } DTS) \quad (2),$$

where the slash symbol attached to the signal name indicates a reversed signal.

The NAND circuit 360 of the final stage creates a masking signal MSK(i) from the outputs Q0 and Q1 of the two NAND circuits 350 and 351 in accordance with theoretical formula (3) below.

$$MSK=(/Q0 \text{ OR} /Q1) \quad (3)$$

As is readily apparent based on theoretical formulas (1) to (3) above, the level of each masking signal MSK(i) is the same as that of the first original masking signal data V0 when the value of the dot type selection data DTS for a single bit is 1. The level of each masking signal MSK(i) is the same as that of the original masking signal data V1 when the value of dot type selection data DTS is zero. It is therefore possible to arbitrarily set the value of each masking signal MSK(i) (which corresponds to the value of the dot type selection data DTS) by varying the values of the original masking signal data V0 and V1.

Thus, the printing apparatus of the present embodiment can smooth the outlines of line drawings while minimizing the reduction in printing speed that accompanies an increase in the volume of data transmitted between the computer 90 and the printing apparatus, because smoothly outlined line drawings can be printed using seven types of dots in accordance with print data supplied from an external device and composed of two gradation values.

Another feature of the present embodiment is that mask pattern selection data MPS and dot type selection data DTS are transmitted separately from each other by the control circuit 40 to the print head 50. Specifically, two signal lines per channel are used to transmit the mask pattern selection data MPS, and a single signal line is used to transmit the dot type selection data DTS. As a result, the communications traffic in each signal line is reduced, making it possible to minimize the reduction in printing speed that accompanies the increased data transmission in the printing apparatus.

The FFC that connects the control circuit 40 and the print head 50 covers the considerable distance between the print head 50 and the control circuit 40 and can deform in conformity with the movements of the carriage 30 on which the print head 50 is mounted, as described above. Since fast data transmission is comparatively difficult to achieve with such a cable under ordinary conditions, the reduction of communications traffic in the FFC represents a considerable benefit in terms of increased printing speed.

C. Second Embodiment of Present Invention

The second embodiment differs from the first embodiment in that a font routine whose resolution is higher than that of the available print data is performed by the printing apparatus. According to the present embodiment, such a font routine allows smoothly outlined text to be printed by increasing the printing resolution of the areas in which text is displayed.

The present printing apparatus can, for example, be provided by an external device with print data PD that contain gradation data whose resolution is 360 dpi in the direction of main scanning and 360 dpi in the direction of sub-scanning, and that also contain text-specifying data for specifying the type of text and the like, making it possible to perform printing operations for displaying texts whose true resolution in the direction of main scanning is 1440 dpi.

Figure 13A:
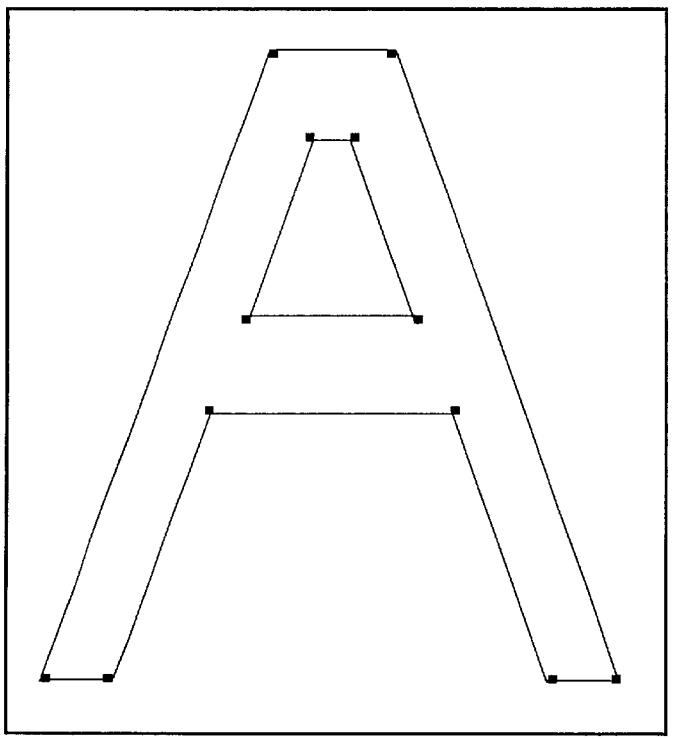
FIGS. 13A–13B are diagrams depicting the specifics of a font routine performed in accordance with a comparative example.
Figure 13B:
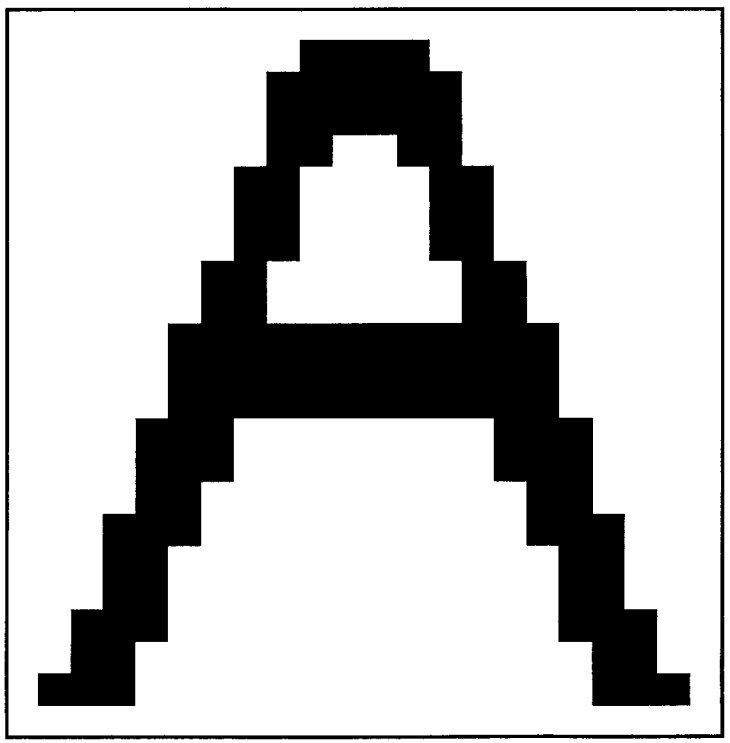

FIGS. 13A–13B are diagrams depicting the specifics of a font routine performed in accordance with a comparative example, that is, the process for creating text A with the aid of an outline font (occasionally referred to herein as a "scalable font") whose character configuration is in the form of vector information. FIG. 13A is a diagram depicting the outline data used to create the outline of text A. The outline data, which are provided to the printing apparatus as data for expressing font outlines, comprises data for expressing discrete points and data for expressing a method for filling in the gaps between the points.

The printing apparatus selects the outline data in accordance with the text-specifying data included in the print data PD and creates gradation data for displaying textual information in a printed image on the basis of the outline data thus selected. According to the present embodiment, the text-specifying data contain information about the size and type of text and the position of the text in a printed image. In the example shown in FIGS. 13A–13B, "A" is used to denote the type of text.

According to the comparative example, the text is represented at the same print resolution as the resolution of the print data PD thus provided. In this example, the print data PD contain gradation data whose resolution is 360 dpi in the direction of main scanning and 360 dpi in the direction of sub-scanning, with the text being displayed at the same resolution. For this reason, the printing apparatus is used to perform a font routine on the assumption that the pixels have a resolution of 360 dpi in the direction of main scanning and 360 dpi in the direction of sub-scanning. Text-expressing binary gradation data are created as a result. The printed text image thus expressed is shown in FIG. 13B.

Figure 14A:
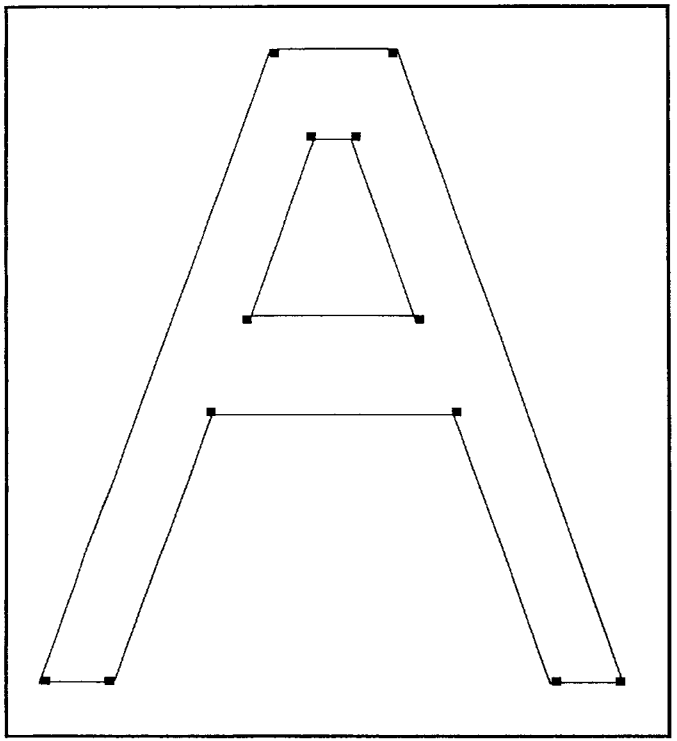
FIGS. 14A–14B are diagrams depicting the specifics of a font routine performed in accordance with a second embodiment of the present invention.
Figure 14B:
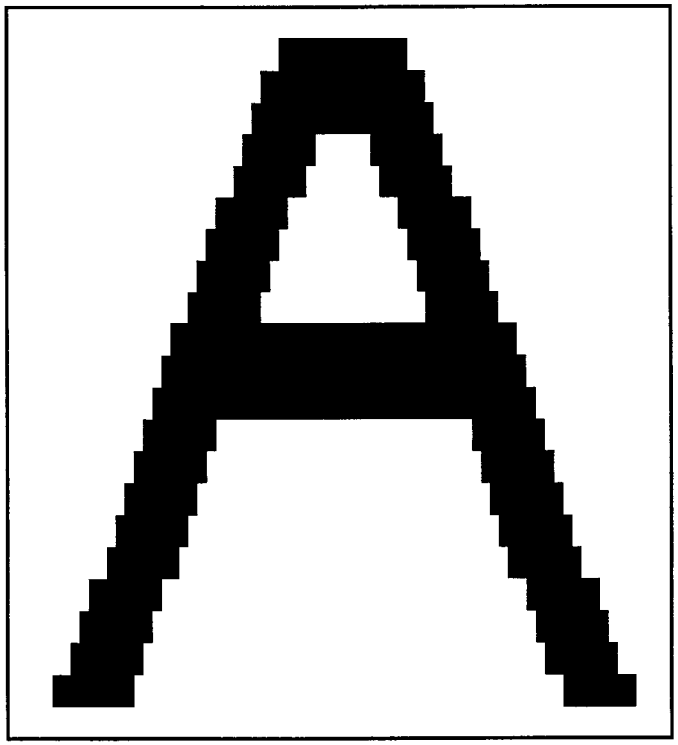

FIGS. 14A–14B are diagrams depicting the specifics of a font routine performed in accordance with the second embodiment of the present invention. In this example, the font routine is performed on the premise that the print resolution in the direction of main scanning is 1440 dpi. Since the font routine yields high print resolution in the direction of main scanning, text A (FIG. 14B), whose outlines are smoother than those of the text A shown in FIG. 13B, can be expressed based on the outline data of FIG. 14A, which are the same as the data in FIG. 13A. The print resolution of 1440 dpi premised on such a routine can be attained by switching the mask patterns for every pixel and enhancing formable dot types in the manner described below.

FIGS. 15A–15F are diagrams illustrating a method for improving the true resolution by switching mask patterns in accordance with the second embodiment of the present invention. FIG. 15A depicts the dot types that can be formed by a first mask pattern, and FIGS. 15B, 15C, and 15D depict the 16 types of dots that can be formed by second, third, and fourth mask patterns, respectively.

The 16 types of dots include all the combinations obtainable by varying the manner in which dots are formed in each cell. As a result, the dots to be formed in each pixel are appropriately selected from these 16 types of dots, making it possible to control the manner in which the dots belonging to this group of dots are formed in the cells. Since the size of the cells corresponds to a print resolution of 1440 dpi in the direction of main scanning (as shown in FIG. 15A), it can be seen that an actual resolution of 1440 dpi can be achieved in the direction of main scanning by controlling the manner in which the dots are formed in the cells.

Dot types can be selected in the following manner in accordance with mask pattern selection data MPS and dot type selection data DTS. FIG. 15E is a diagram depicting the relation between the mask pattern selection data MPS and the selected mask pattern. It can be seen in the drawing that the first, second, third, or fourth mask pattern is selected when the mask pattern selection data MPS is 00, 01, 10, or 11, respectively.

FIG. 15F is a diagram depicting the relation between the 2-bit dot type selection data DTS and the dot types thus selected. It can be seen in the drawing that selecting a mask pattern makes it possible to select the dot type in accordance with the dot type selection data DTS on the basis of this mask pattern. For example, selecting the first mask pattern for the pixel interval of a nozzle causes dot type (a-1), (a-2), (a-2), or (a-4) to be selected when the dot type selection data are 00, 01, 10, or 11, respectively.

With the control unit 45, the following operation is first performed in accordance with the arrangement of gradation values in specific pixels (these pixels correspond to a print resolution of 1440 dpi and belong to pixels that correspond to a resolution of 360 dpi in the direction of main scanning): dots whose configuration is best suited for expressing the arrangement of these gradation values are selected from among the 16 types of dots. The control unit 45 can subsequently create mask pattern selection data MPS in accordance with the selection results. Thus, the present embodiment is also configured such that the control unit 45 functions as the dot selector referred to in the claims. Another feature of the present embodiment is that the pixels related to a resolution of 360 dpi in the direction of main scanning correspond to the first pixels referred to in the claims, and the specific pixels related to a print resolution of 1440 dpi correspond to the second pixels referred to in the claims.

Thus, the present embodiment allows textual displays with a truly high resolution to be recreated through the use of multiple dot types at comparatively low resolutions. Since the font routine for expressing high-resolution texts is performed by the printing apparatus, text outlines can be smoothed without increasing the volume of transmission between the computer 90 and the printing apparatus.

D. Third Embodiment of Present Invention

Figure 17:
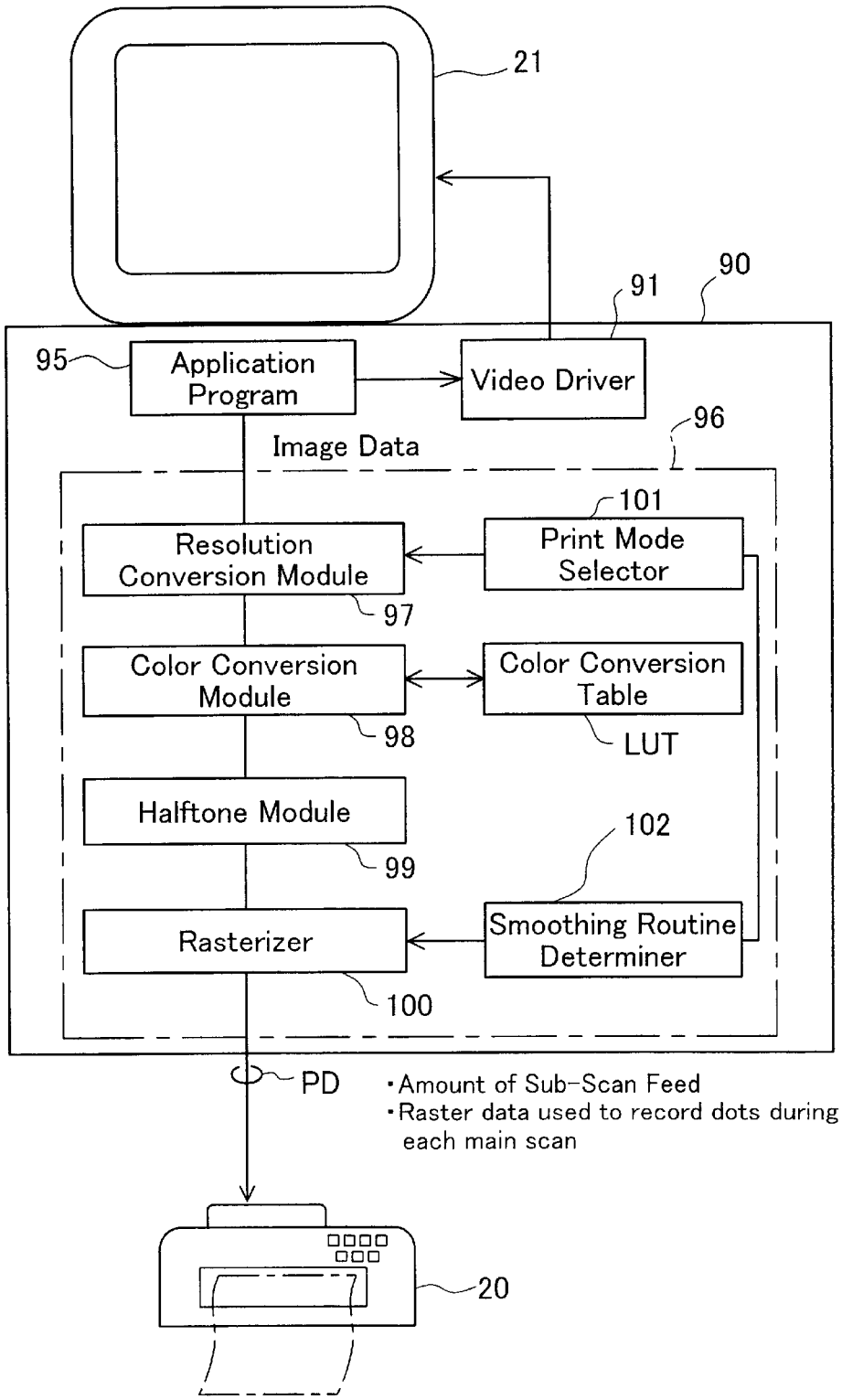
FIG. 17 is a block diagram depicting the structure of a printing system as a embodiment of the present invention.

FIG. 17 is a block diagram depicting the structure of a printing system as a third embodiment of the present invention. The printing system comprises a computer 90 as a print control device, and a color printer 20 as a printing unit. A combination of the color printer 20 and computer 90 can also be broadly defined as a "printing apparatus."

In the computer 90, an application program 95 is executed under the guidance of a specific operating system. The operating system contains a video driver 91 or a printer driver 96, and the application program 95 outputs the print data PD to be transmitted to the color printer 20 via these drivers. The application program 95 processes designated images in the desired manner and displays the images on a CRT 21 by means of a video driver 91.

When the application program 95 issues a print command, the printer driver 96 of the computer 90 receives image data from the application program 95 and converts these data to the print data PD to be supplied to the color printer 20. In the example shown in FIG. 17, the printer driver 96 contains a resolution conversion module 97, a color conversion module 98, a halftone module 99, a rasterizer 100, a color conversion table LUT, a print mode selector 101, and a smoothing process determiner 102.

The role of the resolution conversion module 97 is to convert the resolution of the color image data (that is, the number of pixels per unit length) handled by the application program 95 into a resolution that can be handled by the printer driver 96. The image data converted in terms of resolution in this manner are still in the form of image information composed of three colors (RGB). The color correction module 98 converts the RGB data in individual pixels into multilevel gradation data suitable for a plurality of ink colors and usable by the color printer 20 while the color correction table LUT is consulted.

The color-converted multilevel gradation data may, for example, have 256 gradations. The halftone module 99 executes a halftone routine to allow the color printer 20 to represent the multilevel gradations as dispersed ink dots. The half-toned data are rearranged by the rasterizer 100 according to a sequence in which the data are sent to the color printer 20, and are outputted as final print data PD. The print data PD comprise raster data for specifying the manner in which dots are recorded during main scanning, and data for specifying the extent of sub-scanning. The functions of the print mode selector 101 and smoothing process determiner 102 will be described below.

The four modules 97–100 constituting the printer driver 96 correspond to a program for performing functions whereby print data PD are generated. The program for performing the functions of the printer driver 96 can be stored on a computer-readable storage medium. Examples of such storage media include floppy disks, CD-ROMs, magneto-optical disks, IC cards, ROM cartridges, punch cards, printed matter with bar codes and other printed symbols, internal computer storage devices (RAM, ROM, and other types of memory), external storage devices, and various other computer-readable media.

Figure 18:
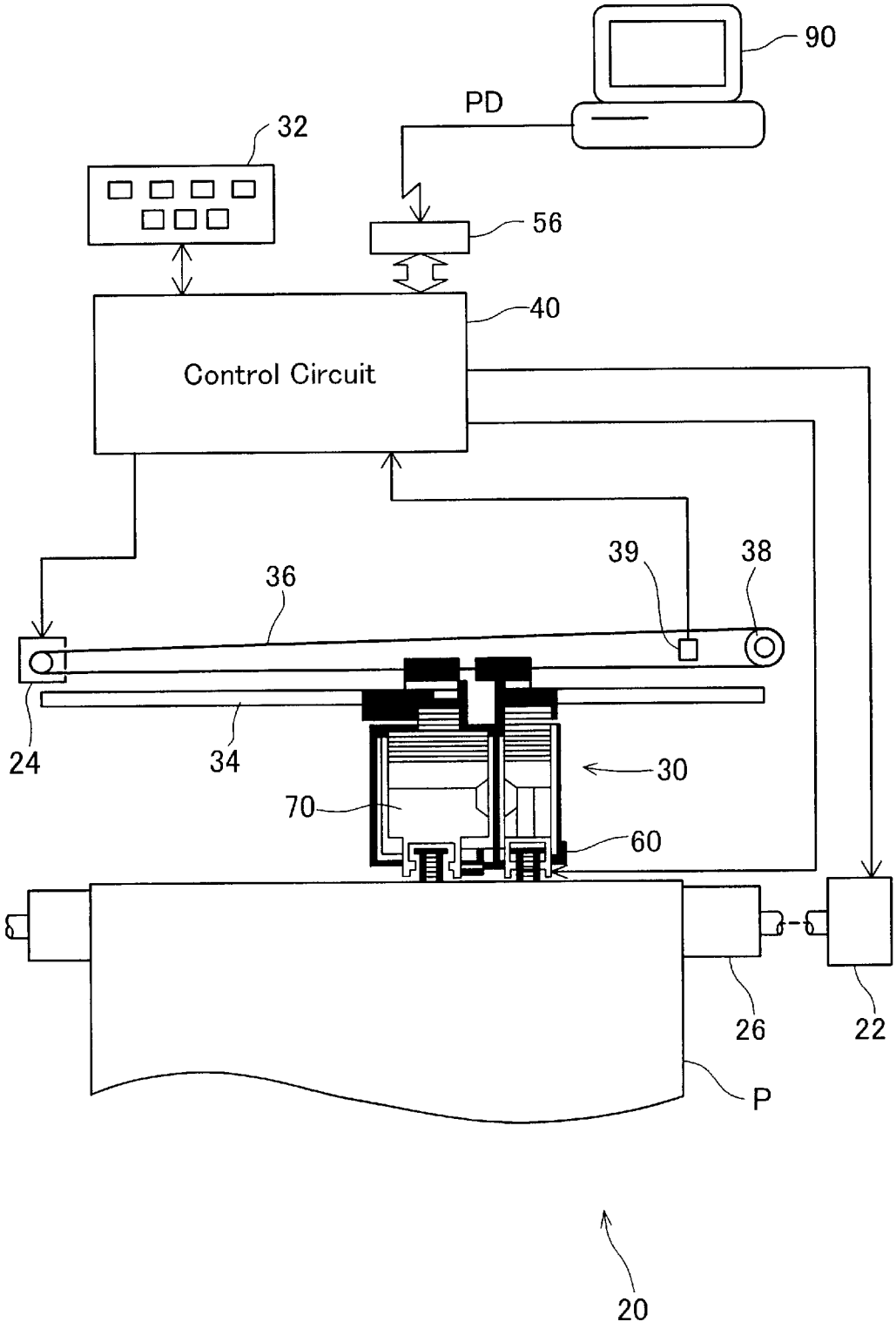
FIG. 18 is a diagram depicting the printer structure.

FIG. 18 is a schematic structural drawing of the color printer 20. The color printer 20 comprises a sub-scanning mechanism for transporting printing paper P in the direction of sub-scanning with the aid of a paper feed motor 22; a main scanning mechanism for reciprocating a carriage 30 in the axial direction (direction of main scanning) of a platen 26 with the aid of a carriage motor 24; a head drive mechanism for actuating a print head unit 60 (also referred to as a "print head assembly") mounted on the carriage 30 and controlling ink ejection and dot formation; and a control circuit 40 for exchanging signals between the paper feed motor 22, the carriage motor 24, the print head unit 60, and a control panel 32. The control circuit 40 is connected to the computer 90 with a connector 56.

The sub-scanning mechanism for transporting the printing paper P is provided with a gear train (not shown) for transmitting the rotation of the paper feed motor 22 to the platen 26 and a paper feed roller (not shown). The main scanning mechanism for reciprocating the carriage 30 comprises a sliding shaft 34 mounted parallel to the axis of the platen 26 and designed to slidably support the carriage 30, a pulley 38 for extending an endless drive belt 36 from the carriage motor 24, and a position sensor 39 for sensing the original position of the carriage 30.

Figure 19:
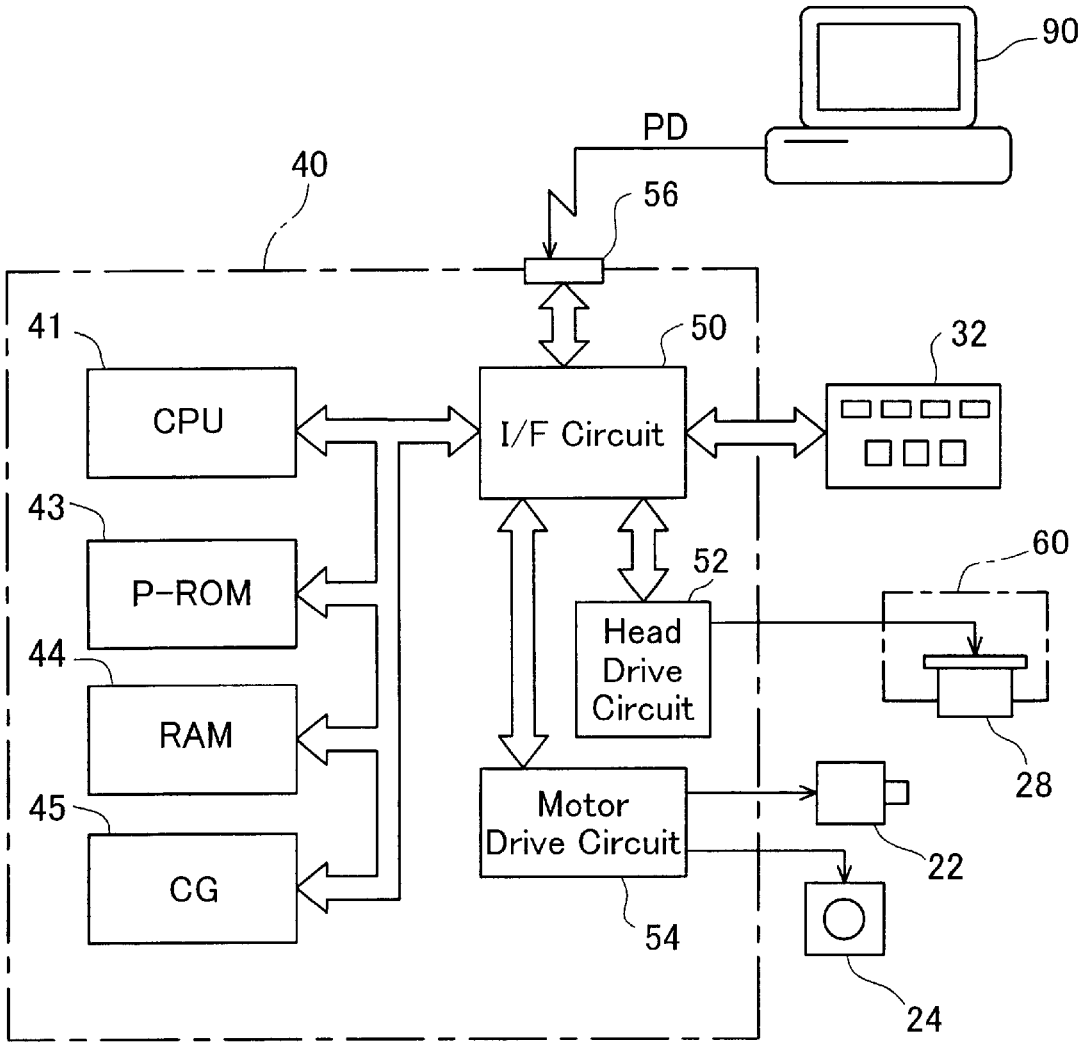
FIG. 19 is a block diagram depicting the structure of the control circuit 40 in a color printer 20.

FIG. 19 is a block diagram depicting the structure of a color printer 20 based on the control circuit 40. The control circuit 40 is configured as an arithmetic logic operation circuit comprising a CPU 41, a programmable ROM (PROM) 43, a RAM 44, and a character generator (CG) 45 containing dot matrices for characters. The control circuit 40 further comprises a I/F circuit 50 for creating a dedicated interface with external motors and so on, a head drive circuit 52 connected to the I/F circuit 50 and designed to eject ink by actuating the print head unit 60, and a motor drive circuit 54 for actuating the paper feed motor 22 and carriage motor 24. The I/F circuit 50 contains a parallel interface circuit and is capable of receiving print data PD from the computer 90 via the connector 56. The color printer 20 prints images in accordance with the print data PD. RAM 44 functions as a buffer memory for the temporary storage of raster data.

The print head unit 60 has a print head 28 and is designed for mounting ink cartridges. The print head unit 60 can be mounted on the color printer 20 and removed as a single component. In other words, the print head unit 60 is replaced when the print head 28 needs to be replaced.

Figure 20:
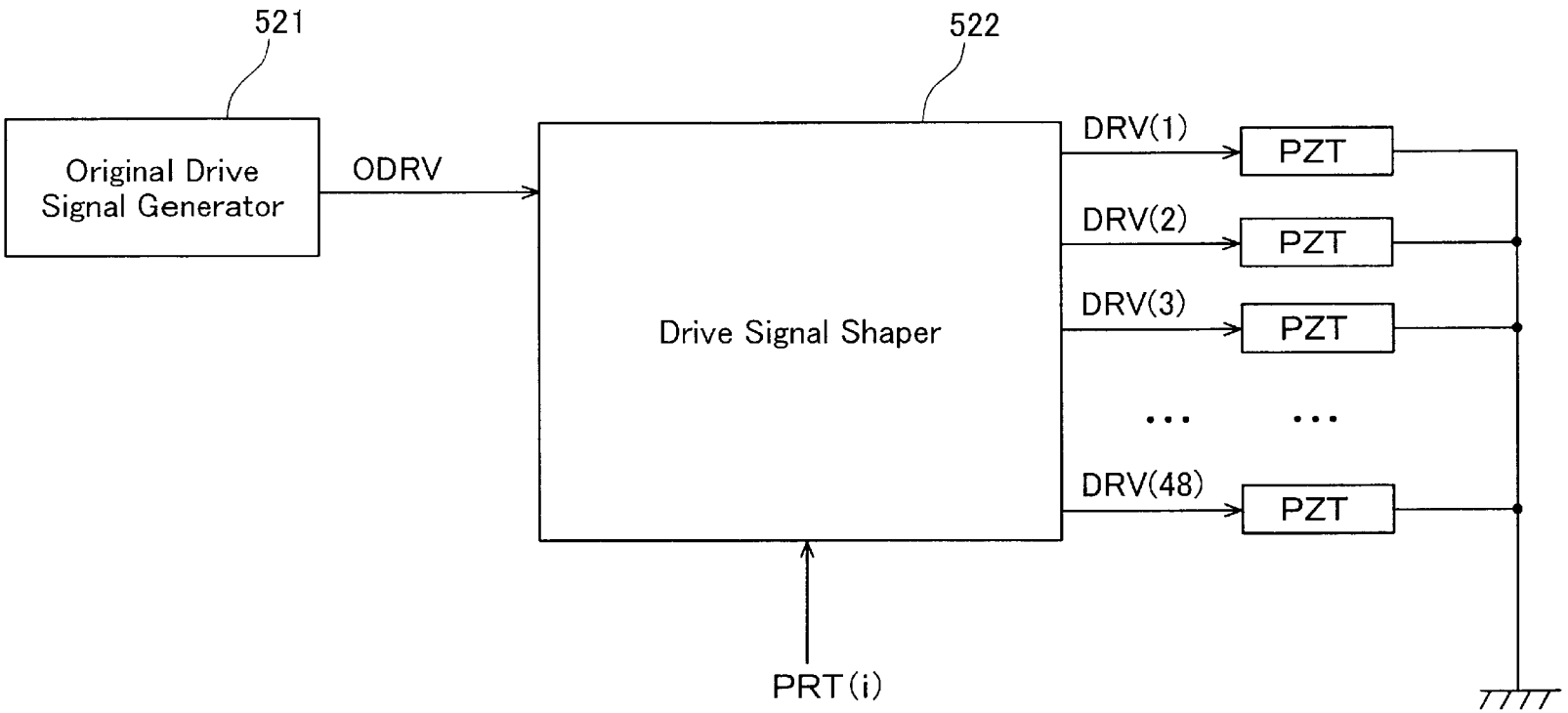
FIG. 20 is a diagram depicting the structure of a head drive circuit 52.

FIG. 20 is a diagram depicting the structure of the head drive circuit 52. The head drive circuit 52 comprises an original drive signal generator 521 and a drive signal shaper 522. The original drive signal generator 521 generates an original drive signal ODRV. The drive signal shaper 522 shapes the original drive signal ODRV in accordance with the inputted print signal PRT(i) and generates an original drive signal ODRV for driving the piezo-elements PZT. The head drive circuit 52 corresponds to the print head drive unit referred to in the claims.

Figures 21A, 21B, 21C, 21D, 21E, 21F, 21G:
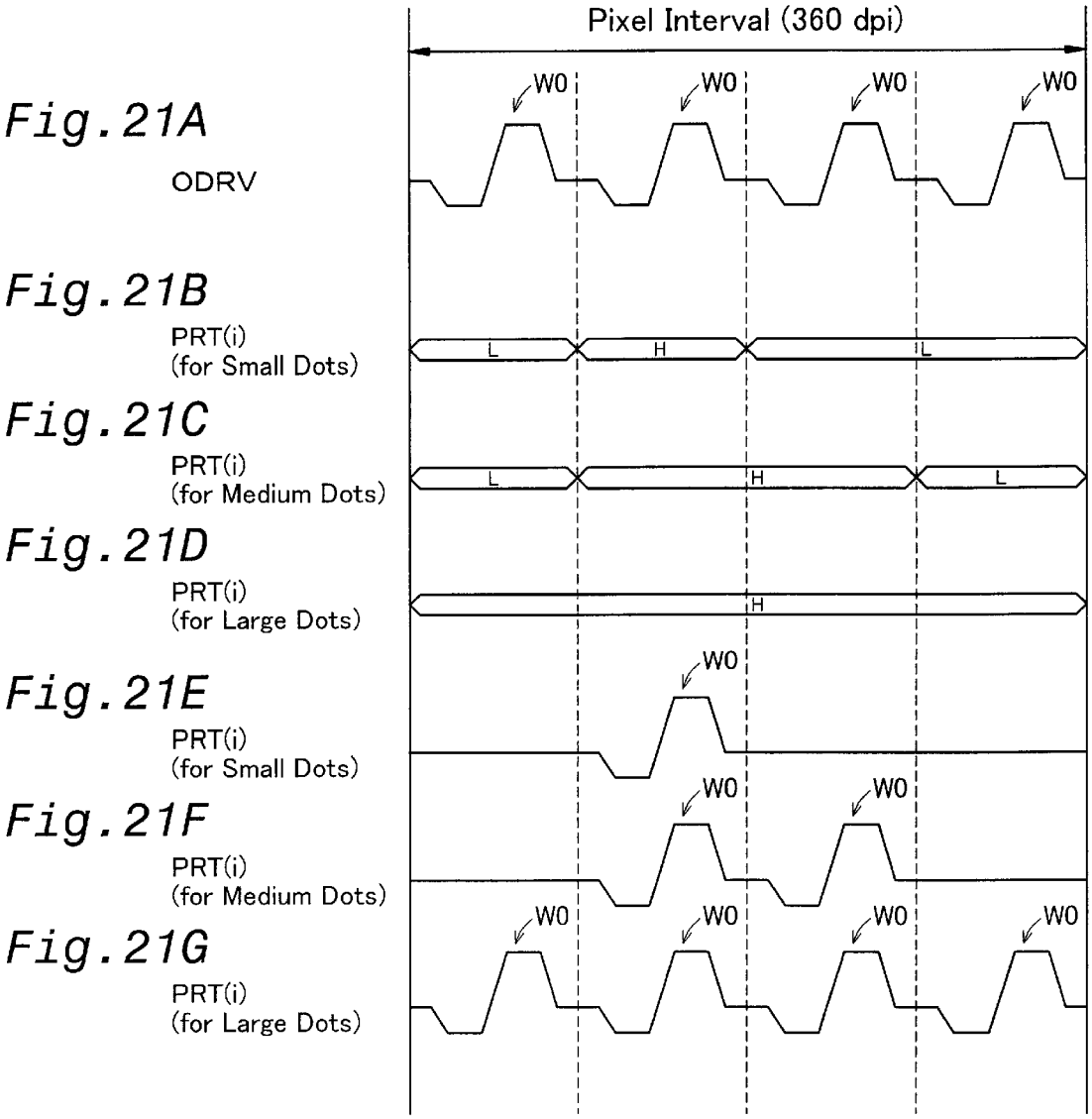
FIGS. 21A–21G are timing charts illustrating the internal operation of the head drive circuit 52.

FIGS. 21A–21G are timing charts illustrating the internal operation of the head drive circuit 52. FIG. 21A depicts the original drive signal ODRV generated by the original drive signal generator 521. As can be seen in the drawing, the original drive signal ODRV comprises four identical waveforms W0 within a single diagram illustrating.

FIGS. 21B to 21D depict the print signals PRT(i) for small, medium, and large dots. The print signals PRT(i) may be "H" or "L" signals in relation to the waveforms W0. The drive signal shaper 522 transmits the original drive signal ODRV when an "H" print signal PRT(i) is entered, and blocks the original drive signal ODRV when an "L" drive signal is entered. Drive signals DRV can thus be created by selectively transmitting the waveforms W0.

FIGS. 21E to 21G depict the drive signals DRV(i) for small, medium, and large dots. The drive signal DRV(i) for a small dot is obtained by extracting solely the second (from left) waveform W0 from the original drive signal ODRV because the "H" level can be achieved solely with respect to the second waveform W0 in the print signal PRT(i) for a small dot. Similarly, the drive signal DRV(i) for a middle dot is obtained by extracting the second and third (from left) waveforms W0 from the original drive signal ODRV, and the drive signal DRV(i) for a large dot is composed of all the waveforms W0 constituting the original drive signal ODRV.

FIGS. 22A–22F are diagrams illustrating the relation between pixel values and the dots formed. If the printed image is a photograph, print data PD containing 2-bit raster data whose pixel values range from 0 to 3 for each pixel color are entered into the control circuit 40 (FIG. 19). The CPU 41 of the control circuit 40 creates a print signal PRT(i) for each nozzle by processing these raster data. A drive signal DRV(i) for actuating the piezo-elements PZT is thus generated in accordance with the pixel values contained in the raster data. Specifically, no drive signal DRV(i) is generated when the corresponding pixel value is zero, and a drive signal DRV(i) for forming a dot of the corresponding size is generated when the pixel value ranges from 1 to 3.

Figure 22A:
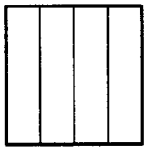
FIGS. 22A–22F are diagrams illustrating the relation between pixel values and the dots formed.
Figure 22B:
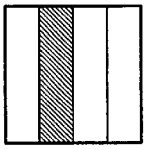
Figure 22C:
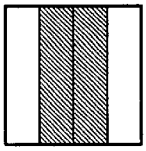
Figure 22D:
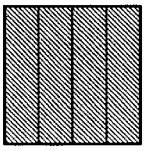

Specifically, no dots are formed when the pixel value is zero, as shown in FIG. 22A. A small dot (second cell from the left) is formed by a single ink drop when the pixel value is 1, as shown in FIG. 22B. A medium dot (second and third cells from the left) is formed by two ink drops when the pixel value is 2, as shown in FIG. 22C. A large dot (all cells) is formed by four ink drops when the pixel value is 3, as shown in FIG. 22D.

Figure 22E:
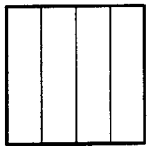
Figure 22F:
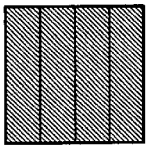

If the printed image is a text, print data PD containing 1-bit raster data whose pixel values are 0 to 1 for each pixel color are entered into the control circuit 40. In this case, no drive signal DRV(i) is generated when the corresponding pixel value is zero, and a drive signal DRV(i) for forming a large dot is generated when the pixel value is one. As a result, no dots are formed when the pixel value is zero, as shown in FIG. 22E. A large dot (all cells) is formed by four ink drops when the pixel value is 1, as shown in FIG. 22F.

Thus, the printing apparatus can express gradations by varying the number of ink drops ejected over the area occupied by a pixel. Specifically, four gradations can be expressed by selectively forming zero, one, two, or four ink drops in the area occupied by a pixel in the case of photographic printing, and two gradations can be expressed by selectively forming zero or four ink drops in the area occupied by a pixel in the case of textual printing. The smoothing process pertaining to the present embodiment is performed using such gradation-expressing functions. The specifics and methods of smoothing are described in detail below.

The color printer 20 whose hardware is configured in the above-described manner operates such that the carriage 30 is reciprocated by the carriage motor 24 while the paper P is transported by the paper feed motor 22, the piezo-elements of the print head 28 are actuated at the same time, and ink drops of each color are ejected to form ink dots and to form multicolored gradated images on the paper P.

Figure 23:
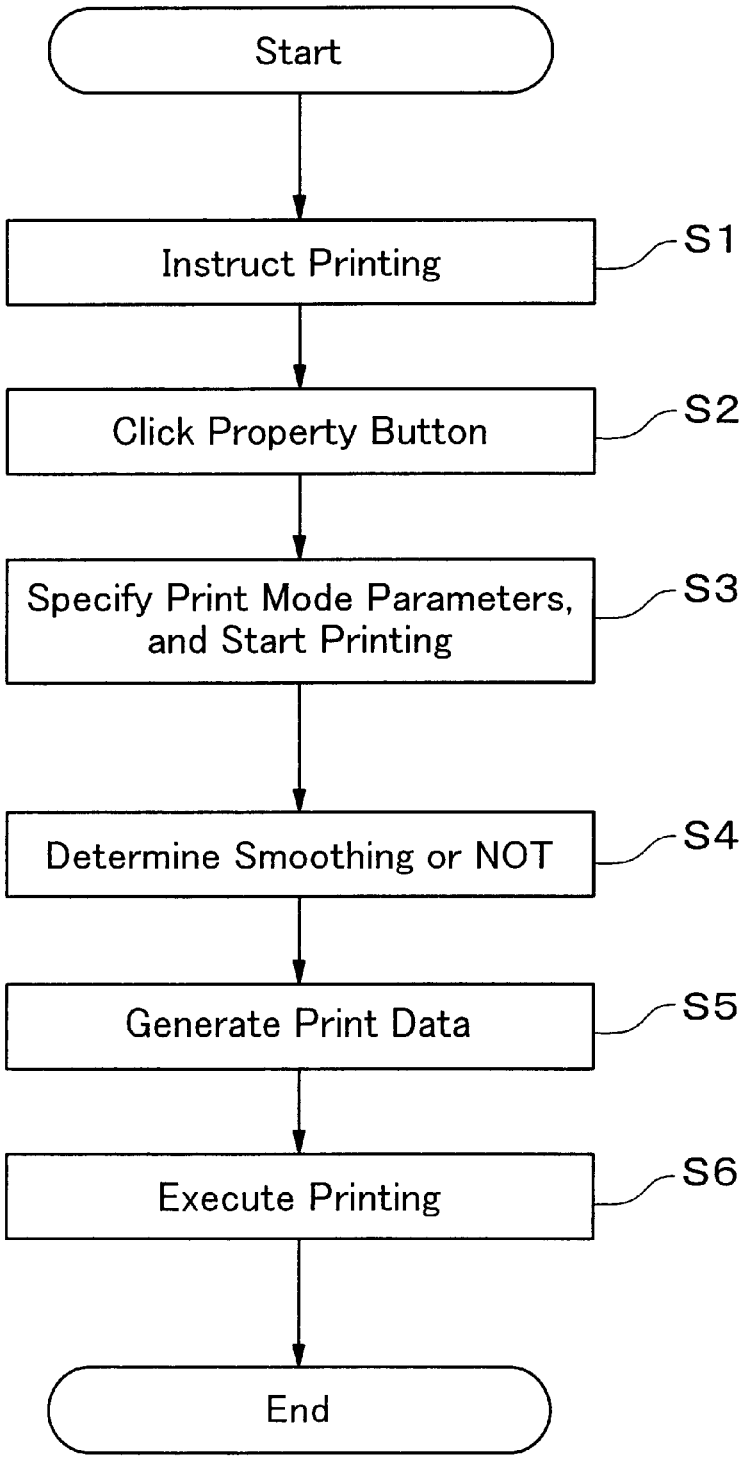
FIG. 23 is a flowchart depicting a procedure for generating print data in accordance with a embodiment of the present invention.
Figure 24:
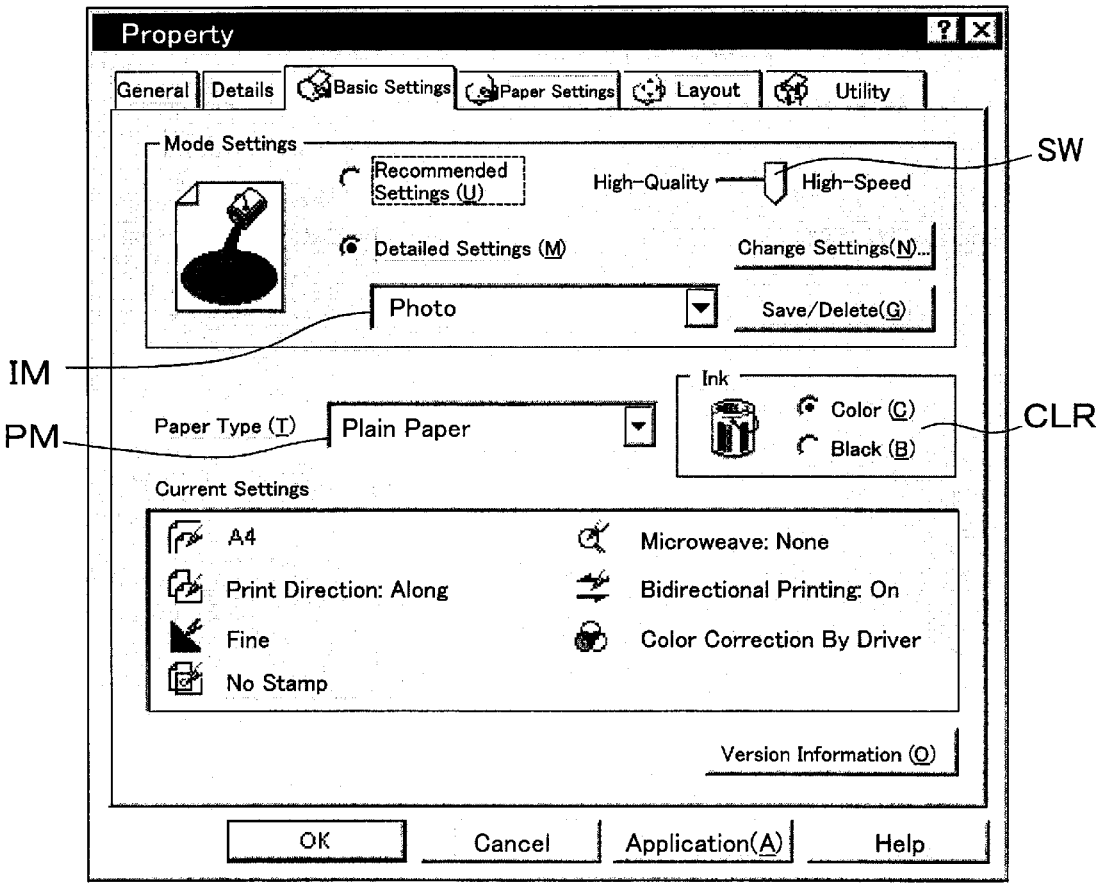
FIG. 24 is a diagram depicting an example of the basic settings screen for displaying print modes on the CRT 21.

FIG. 23 is a flowchart depicting the sequence adopted to perform a printing procedure in accordance with an embodiment of the present invention. In step S1, the user instructs the computer 90 to start printing. When the property button (not shown) in the print dialog box displayed on the CRT 21 is clicked in step S2, the print mode selector 101 (FIG. 17) displays the property settings screen (FIG. 24) on the CRT 21.

The user can indicate a variety of parameters for specifying the print mode on the property settings screen. The basic settings screen for print modes in FIG. 24 has the following elements for specifying a variety of parameters.

(1) Image type selection menu IM: A pull-down menu for selecting one type of image from a list of image types such as text and photographs (2) Print Resolution Setting Switch SW: A switch for specifying a high-quality (high-resolution) option or high-speed (low-resolution) option in FIG. 24

(3) Paper type menu PM: A pull-down menu for selecting one type of paper from a list containing plain paper, ink-jet special paper, and other types of paper (4) Ink color selection button CLR: A button to select the use of color ink or black ink.

The user can set other parameters on the screen for setting the details of print modes, but these parameters are omitted from the detailed description given below.

When the user sets various parameters for the print modes and instructs the system to start printing in step S3 (FIG. 23), the smoothing process determiner 102 (FIG. 17) determines whether smoothing is to be performed in accordance with the print mode thus set in step S4.

FIGS. 25A–25C are diagrams depicting examples of methods for setting the smoothing process in step S4. In the first embodiment, the need for smoothing is determined based on the image type alone by selection from a variety of parameters for specifying the print mode.

The image types include text and photograph, as can be seen in FIG. 25A. According to the first embodiment, the smoothing process determiner 102 performs a smoothing process when the image is a textual type, and does not perform any smoothing process when the image is a photographic type.

In step S5 in FIG. 23, the printer driver 96 generates print data in accordance with the specifics of the smoothing process identification performed in step S4. Specifically, the print data generator incorporates the following types of data into the print data: information about whether smoothing needs to be performed (smoothing process command information) and information about the type of smoothing performed if such a need exists.

In the textual print mode, binary print data PD (a single bit per pixel color) are sent from the computer 90 to the printer 20. The printer 20 prints by smoothing the binary print data (step S6). In the photographic mode, multi-value (two bits per pixel color) print data are sent from the computer 90 to the printer 20. The printer 20 performs printing without smoothing the multi-value print data (step S6).

The smoothing process is carried out by the CPU 41 (FIG. 19) if the print data PD do not contain a smoothing command. Specifically, the smoothing program already stored in the P-ROM 43 is read and executed to perform a smoothing process when it is confirmed that the print data PD contain a smoothing command. Thus, the CPU 41 and P-ROM 43 function as the smoothing processor referred to in the claims.

Figure 26A:
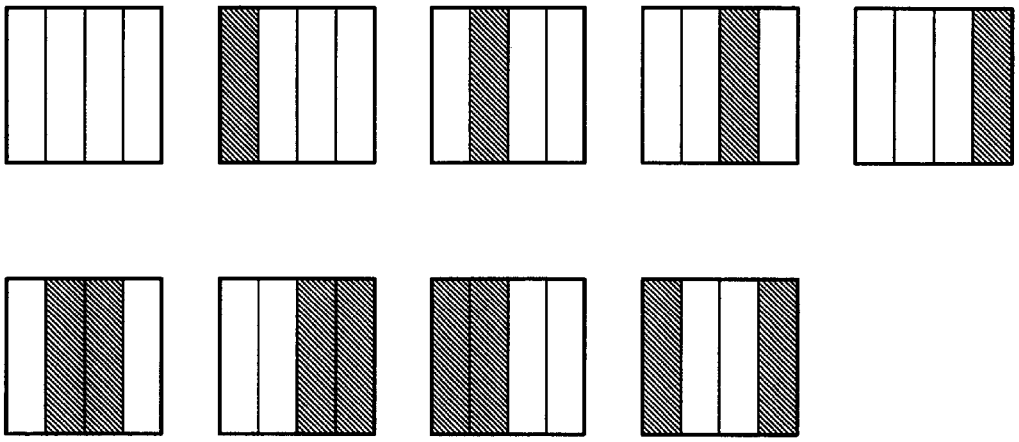
FIGS. 26A–26B are diagrams depicting the relation between the ink drop ejection positions and the values of the pixels to be recorded during smoothing.
Figure 26B:
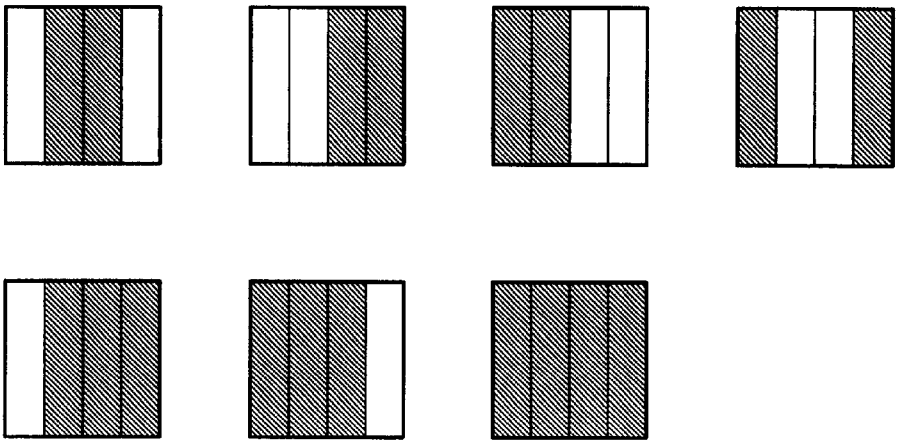

FIGS. 26A–26B are diagrams depicting the relation between the ink drop ejection positions and the values of the pixels to be recorded during smoothing. FIG. 26A depicts positions at which ink drops are ejected when the pixel value is 0. FIG. 26B depicts positions at which ink drops are ejected when the pixel value is 1. A plurality of ink drop ejection positions can thus correspond to a single pixel value. The ink drop ejection positions of each pixel are selected from these plurality of ink drop ejection positions in accordance with the pixel values of this pixel and the pixel values of the pixels adjacent thereto.

The ink drop ejection positions in the bottom tier of FIG. 26A are the same as the ink drop ejection positions in the top tier in FIG. 26B. It is also possible to perform a routine in which the same ink drop ejection positions are selected even when the positions at which the ink drops are ejected have different pixel values.

Although the above smoothing process was described with reference to a procedure in which the ink drop ejection position of each pixel was determined based on the pixel value of each pixel and on the pixel values of eight pixels adjacent to each of these pixels, it is also possible to adopt an approach in which the determination is made by taking into account the pixel values of some of the eight adjacent pixels (rather than all the pixels). The smoothing process should commonly be performed in accordance with the present embodiment such that the ink drop ejection positions are determined in accordance with the pixel value of each pixel and the pixel values of pixels adjacent to each of these pixels.

Although the above embodiments were described with reference to cases in which ink drops were ejected at a plurality of various positions within the area occupied by a single pixel on a print medium to allow dots of different sizes to be formed, it is also possible to adopt an arrangement in which dots of different sizes are formed at the same positions. The present invention can commonly be adapted with ease to a printing apparatus capable of selectively forming any of a plurality of dot types having different sizes. Adopting an arrangement in which ink drops can be ejected at a plurality of different locations within the area occupied by a single pixel on a print medium to form dots of different sizes allows the ink drop ejection positions to be selected from within the area occupied by the pixel, providing a benefit whereby outlines can be further smoothed by selecting the positions in an appropriate manner.

According to the present embodiment, a smoothing process is carried out in the above-described manner only when the image type selected by the user is a textual type, making it possible to achieve a result in which performing the smoothing process allows the outlines of printed images to be smoothed by this routine during the printing of textual documents while preventing the picture quality of photographs from being degraded.

E. Fourth Embodiment

FIG. 25B is a diagram depicting a method for setting the smoothing process in accordance with the second embodiment of the present invention. This method is different from the method for setting the smoothing process in accordance with the first embodiment in that print resolution is added to the parameters that determine whether smoothing needs to be performed. With the exception of the method for setting the smoothing process, the second embodiment is identical to the first embodiment.

Print resolution can be high (high-quality printing) or low (high-speed printing), as shown in FIG. 25B. According to the embodiment, the smoothing process determiner 102 selects settings such that no smoothing is performed when the print resolution is low (high-quality printing), and a smoothing process is performed when the print resolution is low (high-speed printing). The reason is that diagonal outlines have prominent sawtooth-type indentations (jaggies) at low resolution, and the absence of prominent smoothing makes smoothing redundant at high resolution.

Thus, determining whether smoothing is needed is not limited to the use of a single parameter and can be achieved using a combination of two or more different parameters.

F. Fifth Embodiment

FIG. 25C is a diagram depicting a method for setting the smoothing process in accordance with the third embodiment of the present invention. This method is different from the method for setting the smoothing process in accordance with the first or second embodiment in that a first or second smoothing process (the two differ from each other in terms of processing specifics) is selected in accordance with the type of print medium. Except for this difference, the third embodiment is identical to the first and second embodiments.

Print media can be divided into plain paper and paper (e.g. special paper) other than plain paper, as shown in FIG. 25C. According to the embodiment, the smoothing process determiner 102 selects settings that allow a first smoothing process to be performed if the print medium is plain paper, and a second smoothing process to be performed if the print medium is special paper. The reason is that the specifics of a smoothing process performed in order to smooth the outlines of a printed image sometimes vary in accordance with the type of print medium. The reasons that the specifics of a smoothing process vary with the type of print medium will be described below.

In a hypothetical example, the smoothing process shown in FIG. 6B is suitable for plain paper, and the smoothing process shown in FIG. 6C is suitable for special paper. In this case, the third embodiment shown in FIG. 25C will be performed such that the smoothing process shown in FIG. 6B is selected as the first smoothing process, and the smoothing process shown in FIG. 6C is selected as the second smoothing process.

Thus, a smoothing process should preferably be selected from a plurality of usable smoothing process when the specifics of the desired smoothing process vary with the type of print medium.

It can be seen from the above that the smoothing processor should perform a smoothing process to smooth the outlines contained in a printed image when a specific text-printing mode is selected, and should dispense with the smoothing process when a photograph-printing mode is selected. Another preferred feature is that the smoothing processor can select the specifics of the smoothing process in accordance with the type of print medium when the specifics of the desired smoothing process vary with the type of print medium.

G. Modifications

The present invention is not limited by the above-described embodiments or embodiments and can be implemented in a variety of ways as long as the essence thereof is not compromised. For example, the following modifications are possible.

G-1. Although performing a smoothing process in accordance with the first embodiment allows the ink drop ejection position of each pixel to be defined based on the gradation value of each pixel and on the gradation values of the eight pixels adjacent to each of these pixels, it is also possible to adopt an arrangement in which the position is defined with reference to the gradation values of pixels disposed farther away on the periphery of the adjacent pixels. Alternatively, the position may be defined based on the gradation values of some of the eight adjacent pixels rather than all the pixels. The smoothing process used for the first embodiment can be performed in an arbitrary manner as long as the ink drop ejection positions are defined in accordance with the gradation values of each pixel and the gradation values of pixels adjacent to each of these pixels.

G-2. Although the first embodiment was described with reference to a case in which ink drops were ejected and different types of dots were formed at a plurality of different positions within the area occupied by a single pixel on a print medium, it is also possible to adopt an arrangement in which dots of different sizes are formed at the same positions. The first embodiment can be readily adapted to a printing apparatus capable of selectively forming any of a plurality of dots having different sizes. Adopting an arrangement in which ink drops can be ejected at a plurality of different locations within the area occupied by a single pixel on a print medium to form dots of different sizes allows the ink drop ejection positions to be selected from within the area occupied by the pixel, providing a benefit whereby outlines can be further smoothed by selecting the positions in an appropriate manner.

G-3. The present invention can also be adapted to bidirectional printing. With bidirectional printing, the aforementioned plurality of mask patterns should preferably be stored in the mask pattern storage unit such that reversed original masking signal data are selected during forward and return passes, as shown in FIG. 16. Adopting this arrangement allows the extent to which the dots thus formed drift in the direction of main scanning to be controlled during forward and return passes.

G-4. Although the above embodiments were described on the premise of black text printing, the present invention can also be adapted to printing color texts. In a specific example, each color ink should be smoothed when this ink is selected with the aid of the ink color selection button CLR on the property settings screen shown in FIG. 8.

G-5. The invention can also be adapted to a drum printer. In a drum printer, the drum rotates in the direction of main scanning, and the carriage travels in the direction of sub-scanning. The invention can be adapted not only to an ink-jet printer but also to any common printing apparatus in which data are recorded on the surface of a print medium with the aid of a print head.

In the above embodiments, software can be used to perform some of the hardware functions, or, conversely, hardware can be used to perform some of the software functions. For example, some or all of the functions performed by the printer driver 96 shown in FIG. 1 or 17 can be performed by the control circuit 40 inside the printer 20. In this case, some or all of the functions performed by the computer 90, which is a print control device for compiling print data, can be performed by the control circuit 40 of the printer 20.

When some or all of the functions of the present invention are performed by software, this software (computer programs) can be furnished after being stored on a computer-readable recording medium. As used herein, the term "computer-readable recording medium"is not limited to portable recording media such as floppy disks or CD-ROMs and also includes RAM, ROM, and other internal computer storage devices, as well as hard disks and other external storage devices immovably mounted in computers.

What is claimed is:

1. A printing apparatus capable of selectively forming any of N types of dot recording states which are different in an ink amount and/or in an ink-deposited position in a pixel area on a print medium, N being an integer of 2 at least, comprising:

a print head having a plurality of nozzles and a plurality of ejection drive elements for ejecting ink drops from corresponding plurality of nozzles;

a receiver configured to receive print data from an external device, the print data containing gradation data indicative of M values for each pixel in a printed image, M being a positive integer of (N−1) at most;

a dot selector configured to select one type of dot recording state for each pixel from the N types of dot recording states in response to the print data, the selected type of dot recording state smoothing an outline contained in a printed image; and a drive signal generator configured to generate drive signals for driving the ejection drive elements to form the selected type of dot recording state.

2. The printing apparatus in accordance with claim 1, wherein the N types of dot recording states include at least one dot recording state which is identical to another in the ink amount and different in the ink-deposited position.

3. The printing apparatus in accordance with claim 1, wherein a number of bits per pixel in the gradation data is less than a number of bits per pixel in data indicative of the N types of dot recording states.

4. The printing apparatus in accordance with claim 1, wherein the dot selector is configured to select one dot recording state for each pixel to smooth an outline contained in the printed image based on a gradation value of the each pixel and a gradation value of a pixel adjacent to the each pixel according to the gradation data.

5. The printing apparatus in accordance with claim 1, wherein the drive signal generator comprises:

an original drive signal generator configured to generate an original drive signal having a plurality of pulses within a main scan period for a single pixel, the original drive signal being commonly applicable to the plurality of ejection drive elements; and an original drive signal shaper configured to shape the original drive signal with a masking signal to generate the drive signal, the drive signal being configured to represent any of the N types of dot recording states;

the original drive signal shaper comprising:

a mask pattern storage configured to store a plurality of mask patterns, each mask pattern containing a plurality of types of original masking signal data to be used for generating the masking signal;

a mask pattern selector configured to select one mask pattern from the plurality of mask patterns in response to the selection of the dot recording state, the selected mask pattern being capable of reproducing the selected dot recording state;

a masking signal generation circuit configured to select one original masking signal data from the plurality of types of original masking signal data contained in the selected mask pattern in response to the selection of the dot recording state, and also to generate the masking signal with the selected original masking signal data; and a masking unit configured to selectively mask the plurality of pulses in the original drive signals with the masking signals, to thereby generate the drive signal provided to the each ejection drive element.

6. The printing apparatus in accordance with claim 5, further comprising:

a main body of the printing apparatus; and a carriage configured to move in a main scan direction, and also to carry the print head, the masking signal generator, and the masking unit;

wherein the printing apparatus transmits data for the mask pattern selection and data for the original masking signal selection from the main body to the carriage in parallel.

7. The printing apparatus in accordance with claim 5, wherein the printing apparatus has a bidirectional printing function for printing during both forward and return passes of main scan, and stores the plurality of mask patterns in the mask pattern storage, the plurality of mask patterns being stored such that reversed original masking signal data are selected for forward and return passes, respectively.

8. A printing method of selectively recording any of N types of dot recording states which are different in an ink amount and/or in an ink-deposited position in a pixel area on a print medium, N being an integer of 2 at least, comprising the steps of:

(a) providing a print head having a plurality of nozzles and a plurality of ejection drive elements for ejecting ink drops from corresponding plurality of nozzles;

(b) receiving print data from an external device, the print data containing gradation data indicative of M values for each pixel in a printed image, M being a positive integer of (N−1) at most;

(c) selecting one type of dot recording state for each pixel from the N types of dot recording states in response to the print data, the selected type of dot recording state smoothing an outline contained in a printed image; and (d) generating drive signals for driving the ejection drive elements to form the selected type of dot recording state.

9. The method in accordance with claim 8, wherein the N types of dot recording states include at least one dot recording state which is identical to another in the ink amount and different in the ink-deposited position.

10. The method in accordance with claim 8, wherein a number of bits per pixel in the gradation data is less than a number of bits per pixel in data indicative of the N types of dot recording states.

11. The method in accordance with claim 8, wherein the step (c) includes a step of selecting one dot recording state for each pixel to smooth an outline contained in the printed image based on a gradation value of the each pixel and a gradation value of a pixel adjacent to the each pixel according to the gradation data.

12. The method in accordance with claim 8, wherein the step (d) includes the steps of:

generating an original drive signal having a plurality of pulses within a main scan period for a single pixel, the original drive signal being commonly applicable to the plurality of ejection drive elements; and shaping the original drive signal with a masking signal to generate the drive signal, the drive signal being configured to represent any of the N types of dot recording states;

the shaping step includes steps of:

storing a plurality of mask patterns, each mask pattern containing a plurality of types of original masking signal data to be used for generating the masking signal;

selecting one mask pattern from the plurality of mask patterns in response to the selection of the dot recording state, the selected mask pattern being capable of reproducing the selected dot recording state;

selecting one original masking signal data from the plurality of types of original masking signal data contained in the selected mask pattern in response to the selection of the dot recording state, and also generating the masking signal with the selected original masking signal data; and selectively masking the plurality of pulses in the original drive signals with the masking signals, to thereby generate the drive signal provided to the each ejection drive element.

13. The method in accordance with claim 12, further comprising the steps of:

providing a main body of the printing apparatus and a carriage configured to move in a main scan direction, and also to carry the print head, the masking signal generator, and the masking unit and;

transmitting data for the mask pattern selection and data for the original masking signal selection from the main body to the carriage in parallel.

14. The method in accordance with claim 12, further comprising the steps of:

storing the plurality of mask patterns in the mask pattern storage, the plurality of mask patterns being stored such that reversed original masking signal data are selected for forward and return passes of main scan, respectively;

printing during both forward and return passes of main scan.

15. A computer program product for causing a computer to control a printing apparatus for selectively forming any of N types of dot recording states which are different in an ink amount and/or in an ink-deposited position in a pixel area on a print medium, N being an integer of 2 at least, the printing apparatus comprising a print head having a plurality of nozzles and a plurality of ejection drive elements for ejecting ink drops from corresponding plurality of nozzles, the computer program product comprising:

a computer readable medium; and a computer program stored on the computer readable medium, the computer program comprising:

a first program for causing the computer to receive print data from an external device, the print data containing gradation data indicative of M values for each pixel in a printed image, M being a positive integer of (N−1) at most;

a second program for causing the computer to select one type of dot recording state for each pixel from the N types of dot recording states in response to the print data, the selected type of dot recording state smoothing an outline contained in a printed image; and a third program for causing the computer to generate drive signals for driving the ejection drive elements to form the selected type of dot recording state.

16. A printing apparatus capable of selectively forming any of N types of dot recording states which are different in an ink amount and/or in an ink-deposited position in a pixel area on a print medium, N being an integer of 2 at least, comprising:

a print head having a plurality of nozzles and a plurality of ejection drive elements for ejecting ink drops from corresponding plurality of nozzles;

a receiver configured to receive print data from an external device, the print data containing text-specifying data for specifying at least a text to be recorded and gradation data indicative of a gradation value of each of first pixels in a printed image other than text;

a dot selector configured to select one type of dot recording state from the N types of dot recording states in response to the print data, the selected type of dot recording state being to be recorded for each of the first pixels;

a font processor configured to store a scalable font data and also to define gradation values of each of second pixels in response to the text-specifying information and the scalable font data, the second pixels corresponding to a higher resolution than that of the gradation data, the scalable font data containing data indicative of a text shape in a form of vector information; and a drive signal generator configured to generate drive signals for driving the ejection drive elements to form the selected type of dot recording state; and wherein the dot selector selects one type of dot recording state from the N types of dot recording states in response to an arrangement of gradation values of the second pixels within the first pixel, the selected type of dot recording state being best suited for expressing the arrangement of the gradation values.

17. The printing apparatus in accordance with claim 16, wherein the drive signal generator comprises:

an original drive signal generator configured to generate an original drive signal having P pulses within the main scan period of a single pixel, P being an integer of 2 at least, the original drive signal being commonly applicable to the plurality of ejection drive elements; and an original drive signal shaper configured to shape the original drive signal with a masking signal, to thereby generate drive signals configured to represent any of $2^P$ kinds of dot recording states, $2^P$ denoting the P-th power of 2;

the font processor defines the gradation values in the second pixels corresponding to a resolution, the resolution being P times as greater as a resolution of the gradation data;

the original drive signal shaper comprises:

a mask pattern storage configured to store a plurality of mask patterns, each mask pattern containing a plurality of types of original masking signal data to be used for generating the masking signals;

a mask pattern selector configured to select one mask pattern from the plurality of mask patterns in response to the selected type of dot recording state, the selected mask pattern being capable of reproducing the selected type of dot recording state;

a masking signal generation circuit configured to select one type of original masking signal data from the plurality of types of original masking signal data contained in the selected mask pattern in response to the selected type of dot recording state, and also to generate the masking signal with the selected type of original masking signal data; and a masking unit configured to selectively mask the P pulses in the original drive signals with the masking signals, to thereby generate the drive signal provided to the each ejection drive element.

18. The printing apparatus in accordance with claim 17, further comprises:

a main body of the printing apparatus; and a carriage configured to move in a main scan direction, and also to carry the print head, the masking signal generator, and the masking unit; and;

wherein the printing apparatus transmits data for the mask pattern selection and data for the original masking signal selection from the main body to the carriage in parallel.

19. The printing apparatus in accordance with claim 17, wherein the printing apparatus has a bidirectional printing function for printing during both forward and return passes of main scan, and stores the plurality of mask patterns in the mask pattern storage, the plurality of mask patterns being stored such that reversed original masking signal data are selected for forward and return passes, respectively.

20. A printing method of selectively forming any of N types of dot recording states which are different in an ink amount and/or in an ink-deposited position in a pixel area on a print medium, N being an integer of 2 at least, comprising the steps of:

(a) providing a print head having a plurality of nozzles and a plurality of ejection drive elements for ejecting ink drops from corresponding plurality of nozzles;

(b) receiving print data from an external device, the print data containing text-specifying data for specifying at least a text to be recorded and gradation data indicative of a gradation value of each of first pixels in a printed image other than text;

(c) selecting one type of dot recording state from the N types of dot recording states in response to the print data, the selected type of dot recording state being to be recorded for each of the first pixels;

(d) storing a scalable font data and also to define gradation values of each of second pixels in response to the text-specifying information and the scalable font data, the second pixels corresponding to a higher resolution than that of the gradation data, the scalable font data containing data indicative of a text shape in a form of vector information; and (e) generating drive signals for driving the ejection drive elements to form the selected type of dot recording state; and wherein the step (c) includes the step of selecting one type of dot recording state from the N types of dot recording states in response to an arrangement of gradation values of the second pixels within the first pixel, the selected type of dot recording state being best suited for expressing the arrangement of the gradation values.

21. The method in accordance with claim 20, wherein the step (e) includes the steps of:

generating an original drive signal having P pulses within the main scan period of a single pixel, P being an integer of 2 at least, the original drive signal being commonly applicable to the plurality of ejection drive elements; and shaping the original drive signal with a masking signal, thereby generating drive signals configured to represent any of $2^P$ kinds of dot recording states, $2^P$ denoting the P-th power of 2;

the step (d) includes the step of defining the gradation values in the second pixels corresponding to a resolution, the resolution being P times as greater as a resolution of the gradation data;

the original drive signal shaping step includes steps of:

storing a plurality of mask patterns, each mask pattern containing a plurality of types of original masking signal data to be used for generating the masking signals;

selecting one mask pattern from the plurality of mask patterns in response to the selected type of dot recording state, the selected mask pattern being capable of reproducing the selected type of dot recording state;

selecting one type of original masking signal data from the plurality of types of original masking signal data contained in the selected mask pattern in response to the selected type of dot recording state, and also to generate the masking signal with the selected type of original masking signal data; and selectively masking the P pulses in the original drive signals with the masking signals, thereby generating the drive signal provided to the each ejection drive element.

22. The method in accordance with claim 21, further comprising the steps of:

providing a main body of the printing apparatus and a carriage configured to move in a main scan direction, and also to carry the print head, the masking signal generator, and the masking unit and;

transmitting data for the mask pattern selection and data for the original masking signal selection from the main body to the carriage in parallel.

23. The method in accordance with claim 21, further comprising the steps of:

storing the plurality of mask patterns in the mask pattern storage, the plurality of mask patterns being stored such that reversed original masking signal data is selected for forward and return passes of main scan, respectively;

printing during both forward and return passes of main scan.

24. A computer program product for causing a computer to control a printing apparatus for selectively forming any of N types of dot recording states which are different in an ink amount and/or in an ink-deposited position in a pixel area on a print medium, N being an integer of 2 at least, the printing apparatus comprising a print head having a plurality of nozzles and a plurality of ejection drive elements for ejecting ink drops from corresponding plurality of nozzles, the computer program product comprising:

a computer readable medium; and a computer program stored on the computer readable medium, the computer program comprising:

a first program for causing the computer to receive print data from an external device, the print data containing text-specifying data for specifying at least a text to be recorded and gradation data indicative of a gradation value of each of first pixels in a printed image other than text;

a second program for causing the computer to select one type of dot recording state from the N types of dot recording states in response to the print data, the selected type of dot recording state being to be recorded for each of the first pixels; and a third program for causing the computer to store a scalable font data and also to define gradation values of each of second pixels in response to the text-specifying information and the scalable font data, the second pixels corresponding to a higher resolution than that of the gradation data, the scalable font data containing data indicative of a text shape in a form of vector information;

wherein the second program is configured for causing the computer to select one type of dot recording state from the N types of dot recording states in response to an arrangement of gradation values of the second pixels within the first pixel, the selected type of dot recording state being best suited for expressing the arrangement of the gradation values.

25. A printing apparatus for printing by ejecting ink drops from a print head to form dots, comprising:

a print mode selector allowing a user to select one of a plurality of print modes including a specific text print mode suitable for printing text documents, and a photographic print mode suitable for printing photographic images; and a smoothing processor configured to perform a smoothing process in order to smooth an outline contained in a printed image when the specific text print mode is selected, and also to dispense with the smoothing process when the photographic print mode is selected.

26. The printing apparatus in accordance with claim 25, further comprising:

a print head driver configured to form any of N types of dots selectively with each nozzle, the N types of dots being different in size in a single pixel area on a print medium, N being an integer of 2 at least; and a print data generator configured to generate print data indicative of a state of dot formation in each pixel in response to the print mode selection;

wherein the print data generator composes the print data with binary pixel values indicative of presence or absence of the dot formation in each pixel when the specific text print mode is selected, and also composes the print data with multiple pixel values indicative of a state of dot formation in each pixel when the photographic mode is selected; and when the specific text print mode is selected, the smoothing processor selects one type of dot from the N types of dots for each pixel in response to the binary pixel value for the each pixel and the binary pixel value for a pixel adjacent to the each pixel.

27. The printing apparatus in accordance with claim 26, wherein the print head driver is capable of ejecting ink drops at a plurality of different positions within the pixel area on a print medium; and when the specific text print mode is selected, the smoothing processor selects ink-ejected position from the plurality of different positions within the pixel area in response to the binary pixel value for the each pixel and the binary pixel value for a pixel adjacent to the each pixel.

28. The printing apparatus in accordance with claim 27, wherein print mode parameters selectable by the user include a type of print medium; and when the specific text print mode is selected, the smoothing processor selects ink-ejected position from the plurality of different positions within the pixel area in response to the type of print medium, the binary pixel value for the each pixel, and the binary pixel value for a pixel adjacent to the each pixel.

29. The printing apparatus in accordance with claim 25, wherein print mode parameters selectable by the user include ink color; and the smoothing processor is configured to perform the smoothing process for each color of inks when the specific text print mode involving use of color inks is selected.

30. A printing method for printing by ejecting ink drops from a print head to form dots, comprising the steps of:

(a) allowing a user to select one of a plurality of print modes, the plurality of print modes including a specific text print mode suitable for printing text documents, and a photographic print mode suitable for printing photographic images; and (b) performing a smoothing process in order to smooth an outline contained in a printed image when the specific text print mode is selected, while dispensing with the smoothing process when the photographic print mode is selected.

31. The method in accordance with claim 30, further comprising the steps of:

forming any of N types of dots selectively with each nozzle which are different in size in a single pixel area on a print medium, N being an integer of 2 at least; and generating print data indicative of a state of dot formation in each pixel in response to the print mode selection;

composing the print data with binary pixel values indicative of presence or absence of the dot formation in each pixel when the specific text print mode is selected, while composing the print data with multiple pixel values indicative of a state of dot formation in each pixel when the photographic mode is selected;

selecting one type of dot from the N types of dots for each pixel when the specific text print mode is selected, the dot selection being selected in response to the binary pixel value for the each pixel and the binary pixel value for a pixel adjacent to the each pixel.

32. The method in accordance with claim 31, wherein ejecting ink drops at a plurality of different positions within the pixel area on a print medium; and the step (b) includes a step of selecting ink-ejected position from the plurality of different positions within the pixel area when the specific text print mode is selected, the ink-ejected position being selected in response to the binary pixel value for the each pixel and the binary pixel value for a pixel adjacent to the each pixel.

33. The method in accordance with claim 32, wherein print mode parameters selectable by the user include a type of print medium; and the step (b) includes a step of selecting ink-ejected position from the plurality of different positions within the pixel area when the specific text print mode is selected, the ink-ejected position being selected in response to the type of print medium, the binary pixel value for the each pixel, and the binary pixel value for a pixel adjacent to the each pixel.

34. The printing apparatus in accordance with claim 30, wherein print mode parameters selectable by the user include ink color; and the step (b) includes a step of processing the smoothing process for each color of inks when the specific text print mode involving use of color inks is selected.

35. A printing control apparatus for generating print data to be supplied to a printing unit to perform printing by ejecting ink drops from a print head to form dots, comprising:

a print mode selector allowing a user to select one of a plurality of print modes including a specific text print mode suitable for printing text documents, and a photographic print mode suitable for printing photographic images; and a print data generator configured to generate print data containing smoothing command information if the specific text print mode is selected, and also generate the print data devoid of the smoothing command information if the photographic print mode is selected, the smoothing command information commanding the printing unit to perform smoothing process for smoothing an outline contained in a printed image.

36. A printing control method of generating print data to be supplied to a printing unit to perform printing by ejecting ink drops from a print head to form dots, comprising the steps of:

allowing a user to select one of a plurality of print modes including a specific text print mode suitable for printing text documents, and a photographic print mode suitable for printing photographic images; and generating print data containing smoothing command information if the specific text print mode is selected, while generating the print data devoid of the smoothing command information if the photographic print mode is selected, the smoothing command information commanding the printing unit to perform a smoothing process for smoothing an outline contained in a printed image.

37. A printing apparatus for printing by ejecting ink drops from a print head and forming dots in response to supplied printing data, comprising:

a smoothing processor configured to perform a smoothing process if the print data contains smoothing command information, and NOT to perform the smoothing process if the data does not contain the smoothing command information, the smoothing command information indicating that the smoothing process is to be performed to smooth an outline contained in a printed image.

38. A printing method of printing by ejecting ink drops from a print head and forming dots in response to supplied printing data, comprising the step of:

performing a smoothing process if the print data contain smoothing command information, while NOT performing the smoothing process if the data does not contain the smoothing command information, the smoothing command information indicating that the smoothing process is to be processed to smooth an outline contained in a printed image.

39. A computer program product for causing a computer to control a printing apparatus for printing by ejecting ink drops from a print head to form dots, the computer program product comprising:

a computer readable medium; and a computer program stored on the computer readable medium, the computer program comprising:

a first program for causing the computer to allow a user to select one of a plurality of print modes including a specific text print mode suitable for printing text documents and a photographic print mode suitable for printing photographic images; and a second program for causing the computer to perform a smoothing process in order to smooth an outline contained in a printed image when the specific text print mode is selected, and to dispense with the smoothing process when the photographic print mode is selected.

* * * * *